US011459868B2

(12) United States Patent
Fan et al.

(10) Patent No.: US 11,459,868 B2
(45) Date of Patent: Oct. 4, 2022

(54) MULTI-WELL RANGING AND DRILL PATH DETERMINATION

(71) Applicant: HALLIBURTON ENERGY SERVICES, INC., Houston, TX (US)

(72) Inventors: Yijing Fan, Singapore (SG); Burkay Donderici, Pittsford, NY (US); Hsu-Hsiang Wu, Sugar Land, TX (US); Li Pan, Singapore (SG)

(73) Assignee: Halliburton Energy Services, Inc., Houston, TX (US)

( * ) Notice: Subject to any disclaimer, the term of this patent is extended or adjusted under 35 U.S.C. 154(b) by 821 days.

(21) Appl. No.: 16/318,083

(22) PCT Filed: Mar. 26, 2018

(86) PCT No.: PCT/US2018/024368

§ 371 (c)(1),
(2) Date: Jan. 15, 2019

(87) PCT Pub. No.: WO2019/190464

PCT Pub. Date: Oct. 3, 2019

(65) Prior Publication Data

US 2021/0363870 A1 Nov. 25, 2021

(51) Int. Cl.
*E21B 43/30* (2006.01)
*E21B 47/0228* (2012.01)
(Continued)

(52) U.S. Cl.
CPC ..... *E21B 43/305* (2013.01); *E21B 7/04* (2013.01); *E21B 43/2406* (2013.01);
(Continued)

(58) Field of Classification Search
CPC ..... E21B 43/305; E21B 43/2406; E21B 47/0228; E21B 7/04; E21B 44/00; E21B 2200/20; E21B 2200/22
See application file for complete search history.

(56) References Cited

U.S. PATENT DOCUMENTS 8,618,803 B2 12/2013 Rodney et al.
2008/0041626 A1 2/2008 Clark
(Continued)

FOREIGN PATENT DOCUMENTS

EP 1442320 B1 4/2014

OTHER PUBLICATIONS

International Search Report and Written Opinion; PCT Application No. PCT/US2018/024368; dated Dec. 26, 2018.

*Primary Examiner* — Abby J Flynn
*Assistant Examiner* — Yanick A Akaragwe
(74) *Attorney, Agent, or Firm* — Polsinelli PC

(57) ABSTRACT

An apparatus, method, and system for multi-well ranging and planning of a second injector well in the presence of a first injector well in close proximity to a producer well. The method includes generating a three-well forward simulation model using survey data for a producer well, survey data for a first injector well, survey data for a first section of a second injector well, a producer well casing property profile, and a formation resistivity parameter. The method provides for determining the offset between the true magnetic sensor position in the BHA and a planned depth position. The method determines ranging distance and direction of the drilling well to target well using the offset between the true magnetic sensor position and the first planned depth position. The method helps to adjust directional drilling parameter to achieve constant ranging distance between drilling well and target well.

18 Claims, 12 Drawing Sheets

(51) Int. Cl.

| | |
|---|---|
| ***E21B 7/04*** | (2006.01) |
| ***E21B 43/24*** | (2006.01) |
| ***E21B 44/00*** | (2006.01) |

(52) U.S. Cl.
CPC ..... *E21B 44/00* (2013.01); *E21B 47/0228* (2020.05); *E21B 2200/20* (2020.05); *E21B 2200/22* (2020.05)

(56) References Cited

U.S. PATENT DOCUMENTS

| | | | | |
|---|---|---|---|---|
| 2008/0275648 | A1 | 11/2008 | Illfelder | |
| 2009/0255661 | A1 | 10/2009 | Clark | |
| 2010/0155139 | A1* | 6/2010 | Kuckes ..... | E21B 47/01 175/45 |
| 2011/0088890 | A1 | 4/2011 | Clark | |
| 2016/0273337 | A1 | 9/2016 | Donderici et al. | |
| 2017/0138173 | A1* | 5/2017 | Estes ..... | G01V 3/26 |

* cited by examiner

MULTI-WELL RANGING AND DRILL PATH DETERMINATION

CROSS-REFERENCE TO RELATED APPLICATIONS

This application is a national stage entry of PCT/US2018/024368 filed Mar. 26, 2018, said application is expressly incorporated herein in its entirety.

FIELD

The present disclosure relates to wellbore drilling operations. In particular, the present disclosure relates to devices, methods, and systems, for improved multi-well ranging and drill path determination for the drilling of multiple wellbores relative to one another.

BACKGROUND

Wellbores are drilled into the earth for a variety of purposes including tapping into hydrocarbon bearing formations to extract the hydrocarbons for use as fuel, lubricants, chemical production, and other purposes. In order to enhance the recovery of hydrocarbons from a formation or wellbore, an operational technique known as steam assisted gravity drainage (SAGD) may be used. SAGD is a procedure that utilizes steam in conjunction with at least two wellbores spaced apart from each other. Specifically, SAGD facilitates the production of low mobility heavy oil in a formation through the injection of high pressure, high temperature steam into the formation. This high pressure, high temperature steam reduces the viscosity of the heavy oil in order to enhance extraction.

The injection of steam into the formation occurs via an injector wellbore that is drilled above and parallel to a producing wellbore. As the viscosity of the heavy oil in the formation around the injector wellbore is reduced, the heavy oil in the formation drains into the lower producing wellbore, from which the oil is extracted. The injector well is drilled in close proximity to the producing wellbore since if the injector wellbore is positioned too far from the producer wellbore, the efficiency of the SAGD process is reduced. However, if the injector wellbore is positioned too close to the producer wellbore, the producing wellbore would be exposed to very high pressure and temperature. Preferably, the injector and producing wellbores are drilled at a distance of only a few meters from one another. In order to help guide the drilling path of the injector well with respect to the producing wellbore, various "ranging" techniques may be employed.

Over time, the first injector wellbore will age and either fail or become ineffective as a SAGD injector well. Therefore, additional injector wells will need to be drilled. The faster the re-drills can be performed, the greater the production efficiency that will be achieved by the operator. Consequently, efficient and effective methods for multi-well ranging and drill path determination are desirable.

BRIEF DESCRIPTION OF THE DRAWINGS

In order to describe the manner in which the advantages and features of the disclosure can be obtained, reference is made to embodiments thereof which are illustrated in the appended drawings. Understanding that these drawings depict only exemplary embodiments of the disclosure and are not therefore to be considered to be limiting of its scope, the principles herein are described and explained with additional specificity and detail through the use of the accompanying drawings in which.

DETAILED DESCRIPTION

Figure 1:
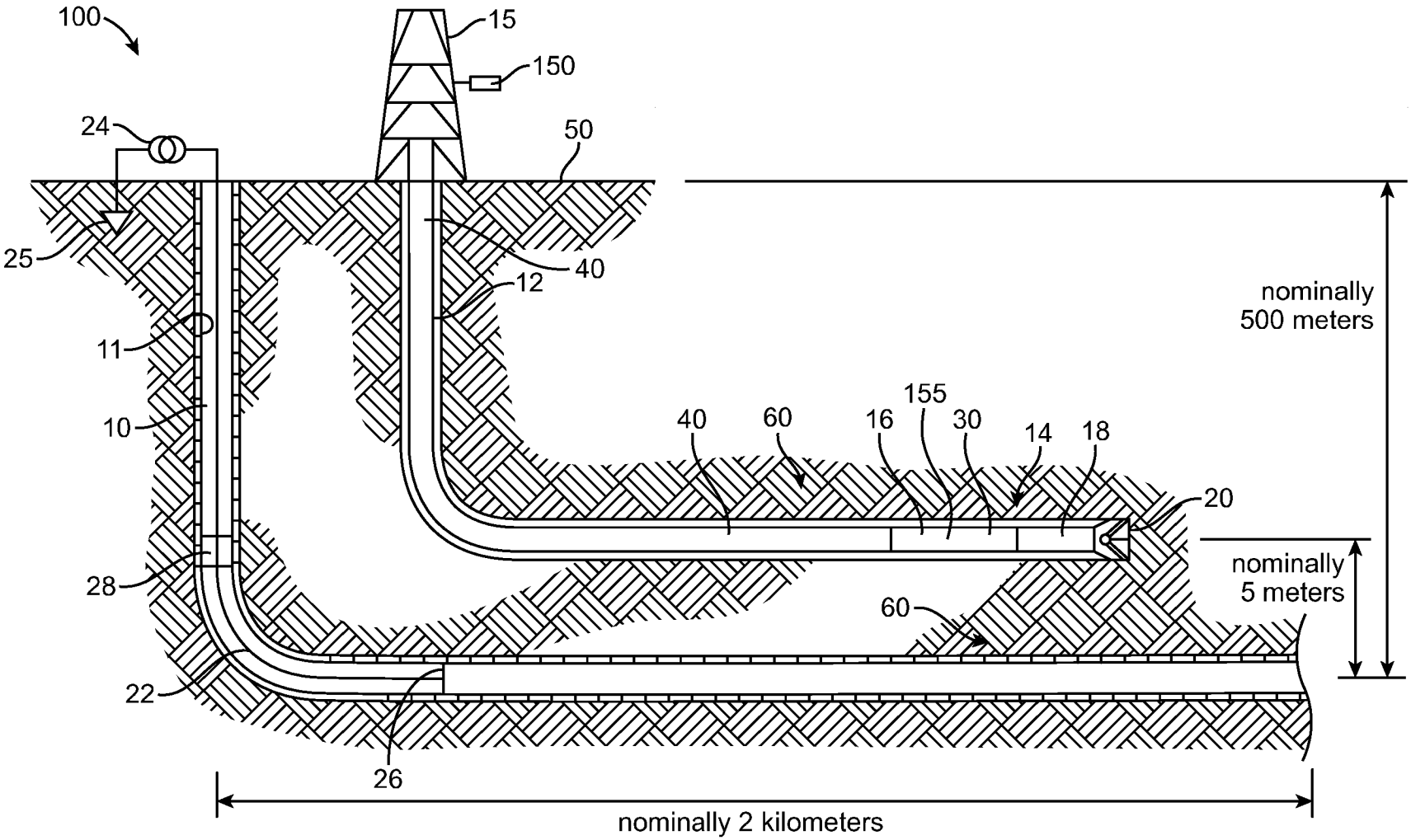
FIG. 1 is a diagram of a SAGD drilling operating environment, according to an exemplary embodiment of the present disclosure.

Various embodiments of the disclosure are discussed in detail below. While specific implementations are discussed, it should be understood that this is done for illustration purposes only. A person skilled in the relevant art will recognize that other components and configurations may be used without parting from the spirit and scope of the disclosure.

It should be understood at the outset that although illustrative implementations of one or more embodiments are illustrated below, the disclosed apparatus and methods may be implemented using any number of techniques. The disclosure should in no way be limited to the illustrative implementations, drawings, and techniques illustrated herein, but may be modified within the scope of the appended claims along with their full scope of equivalents.

Unless otherwise specified, any use of any form of the terms "connect," "couple," or any other term describing an interaction between elements is not meant to limit the interaction to direct interaction between the elements and also may include indirect interaction between the elements described. The various characteristics described in more detail below, will be readily apparent to those skilled in the art with the aid of this disclosure upon reading the following detailed description, and by referring to the accompanying drawings. The present disclosure describes a ranging technique to drill a new second injector well or a sidetrack in the presence of an old first injector well in close proximity to the producer well. The presently disclosed ranging technique does not require access to either the producer well or the older injector wells (interference wells). In particular, the present disclosure is directed to injector well drill path determination using a multi-well ranging method that includes pre-well planning based on the resistivity and casing property data determined from the current profile along the producer well.

According to the present disclosure, a first injector well may be drilled near a producer well using industry standard magnetic ranging with surface excitation. A formation resistivity and casing ("resistivity/casing") property profile of the producer well is then determined. This may be determined based on current profile information of a producer well. The current profile information may include a current profile and/or a current leakage profile of the producer well. The current profile along the producer well may be obtained from the ranging results used for the first injector well, or other ranging measurements. From this current profile, an inversion algorithm may be employed to estimate the surrounding formation resistivity and casing property profile along the producer well. Alternatively, a current leakage profile may be used to determine formation resistivity/casing property profile. In some instances, the current leakage profile may be determined from the magnetic ranging measurements. Alternatively, the current leakage profile may be determined from the current profile. The formation resistivity/casing may then be determined based on the current leakage profile. Accordingly, given the relationship between current profile and current leakage profile either of these may be used for determining the resistivity/casing property profile of the producer well.

Pre-well modeling may then be carried out using the resistivity/casing property profile to generate a three-well model that includes the designed drill path for the new second injector well. The predicted magnetic field distribution in the interested domain may be output to 3D coordinates as a reference ("look-up") table. In real-time drilling operation of the second injector well, the magnetic field received at the MWD sensor, located in the bottomhole assembly (BHA) of the second injector drillstring, may be used to compare with the reference look-up table to obtain the MWD sensor position. The offset between the look-up sensor position and the planned sensor position may be used to determine the ranging distance and direction. The offset may also help to determine the adjustment of drilling direction. The presently disclosed ranging technique and system can also be used in multiple well applications in which there are more than one nearby interference wells.

FIG. 1 illustrates a SAGD drilling operating environment 100 according to an illustrative embodiment of the present disclosure. As depicted in FIG. 1, a producer wellbore 10 is drilled through formation 60 using any suitable drilling technique. Thereafter, producer wellbore 10 is cased with casing string 11. An injector well 12 is subsequently drilled using drillstring 40 having bottomhole assembly (BHA) 14 and extending from derrick 15. BHA 14 may be, for example, a logging while drilling (LWD) assembly, measurement while drilling assembly (MWD), or other desired drilling assembly. The BHA 14 further includes a sensor sub 16, a drilling motor 18, and a drill bit 20.

The sensor sub 16 may include one or more electromagnetic sensors, such as a magnetic field sensor 30, as well as circuitry for data communication to and from one or more computing devices 150 located on the Earth's surface 50 or computing devices 155 included in the BHA 14. Computing devices 150, 155 are coupled to at least one magnetic field sensor 30. Magnetic field sensor 30 may be a MWD sensor capable of measuring a magnetic field. Computing devices 150, 155 are configured to receive data from the one or more electromagnetic sensors, such as magnetic field sensor 30 in the BHA 14, and to carry out the methods of the present disclosure.

Figure 4:
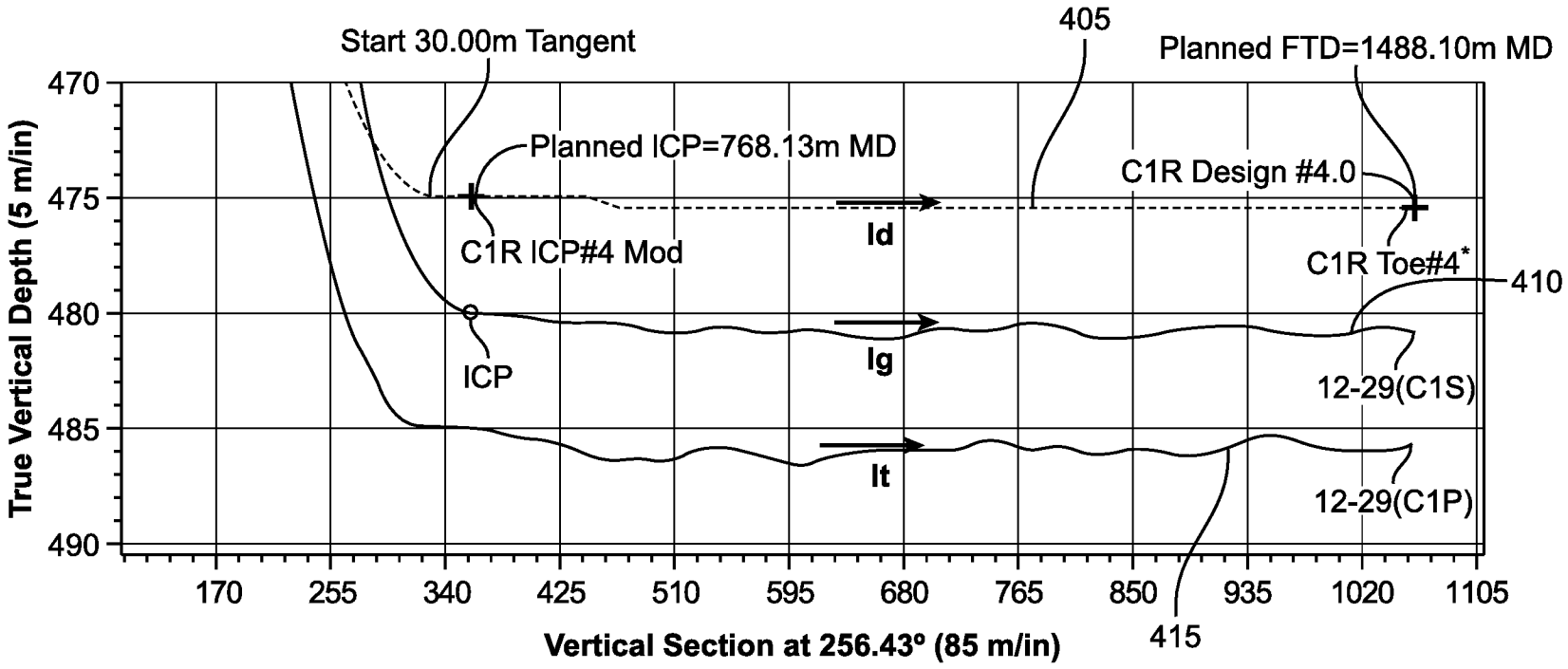
FIG. 4 illustrates a second injector well drilled 5 meters above a first injector well and a target well (producing well), according to an exemplary embodiment of the present disclosure.
Figure 5:
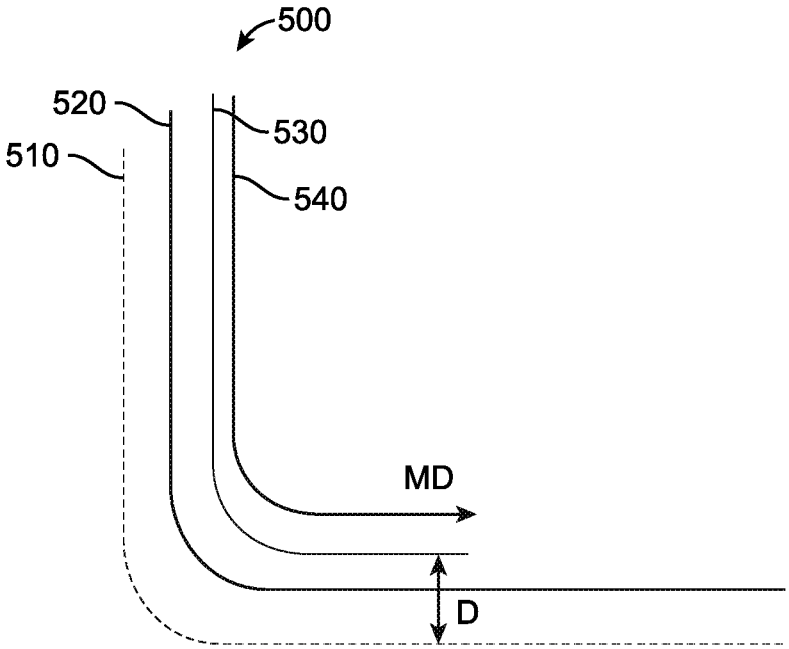
FIG. 5 illustrates a SAGD drilling operating environment, according to an exemplary embodiment of the present disclosure.
Figure 7:
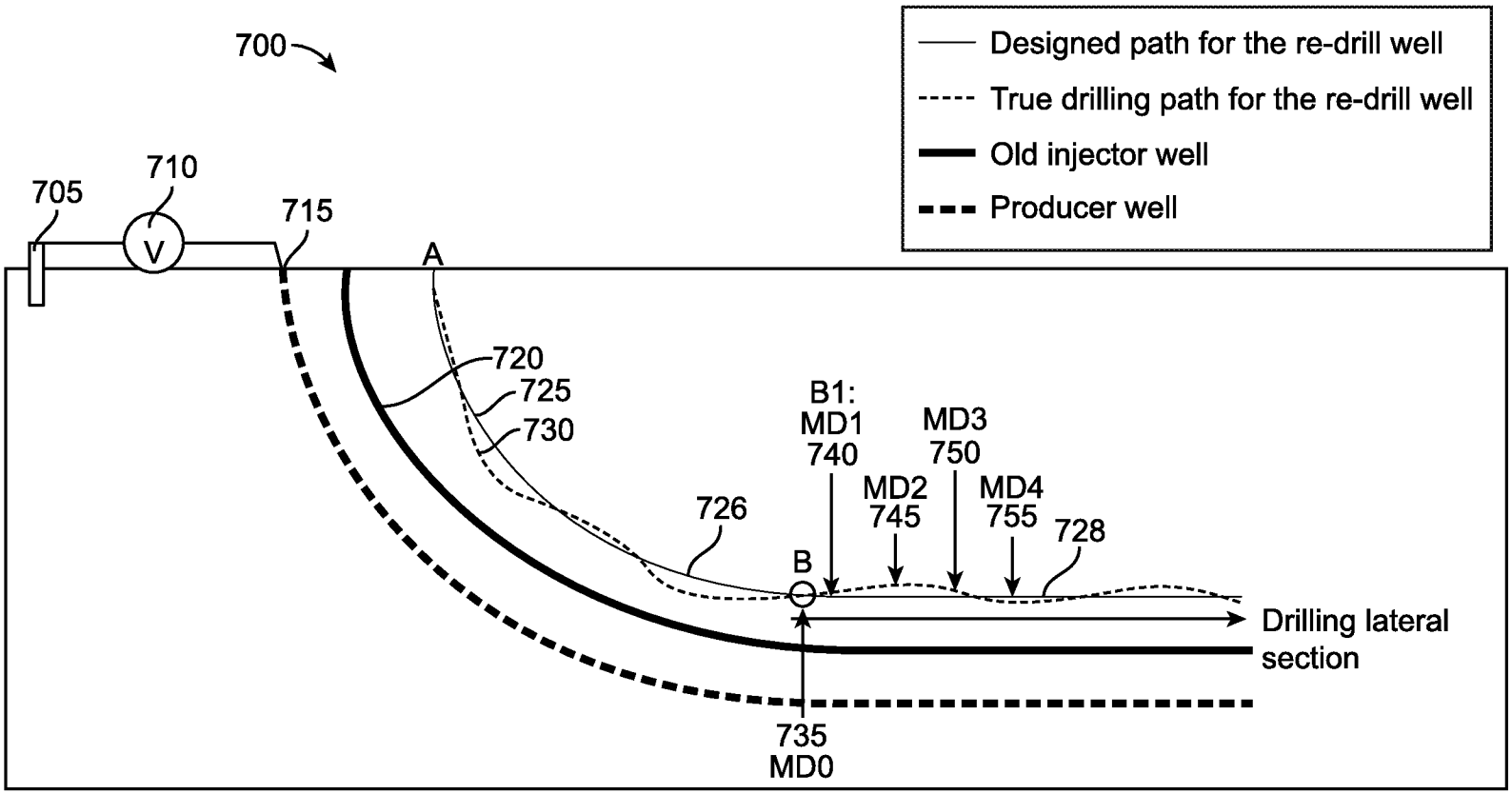
FIG. 7 illustrates a ranging procedure for drilling a second injection well, according to an exemplary embodiment of the present disclosure.

While only one injector well 12 is shown in FIG. 1, the SAGD drilling operating environment 100 may also include one or more earlier injector wells drilled in proximity to the producer wellbore 10, such as is depicted in FIGS. 4, 5, and 7. Injector well 12 may be a first injector well or a second injector well drilled in proximity to both the producer well 10 and the first injector well, according to the presently disclosed methods.

According to the present disclosure, the first injector well may be drilled using industry standard magnetic ranging with surface excitation. The current profile along the producer well 10 can be obtained from the ranging results. An inversion algorithm may be employed to estimate the resistivity of surrounding formation 60 as well as the casing property profile along the producer well 10 from the current profile.

Surface excitation is a method of generating a ranging signal without the need for complex cabling and equipment. Surface excitation involves injecting a current into the casing 11 of the producer well 10 at the surface 50 (e.g., at the well head) using a current source 24 coupled to a ground stake 25. The current travels along the casing down-hole and generates a magnetic field downhole that originates from the producer well 10 via direct transmission, and can be measured at a distance (e.g., in a drilling well) for ranging purposes.

Figure 2:
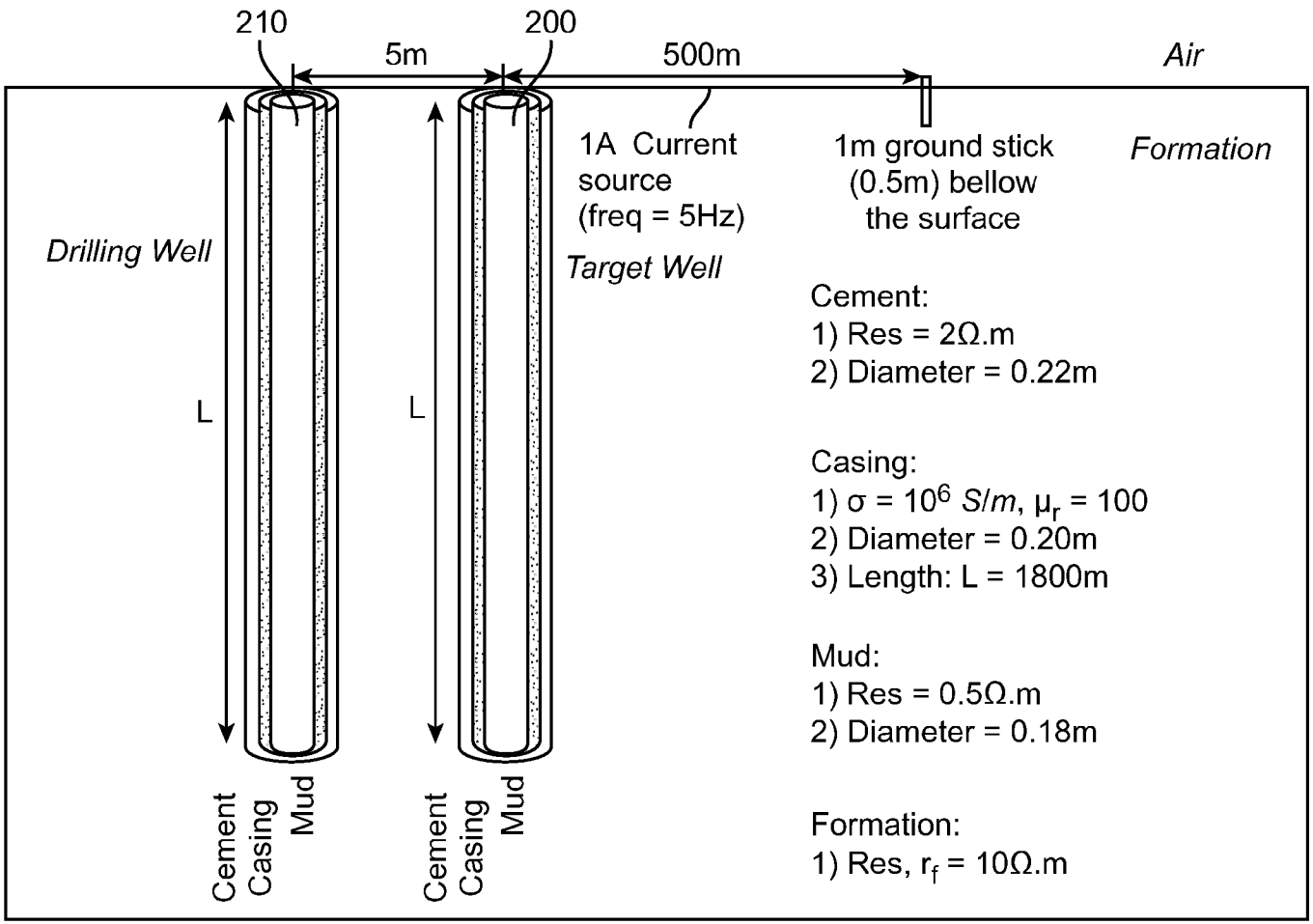
FIG. 2 illustrates a modeling example of current leakage between two nearby wells in a conductive medium, according to an exemplary embodiment of the present disclosure.
Figure 3:
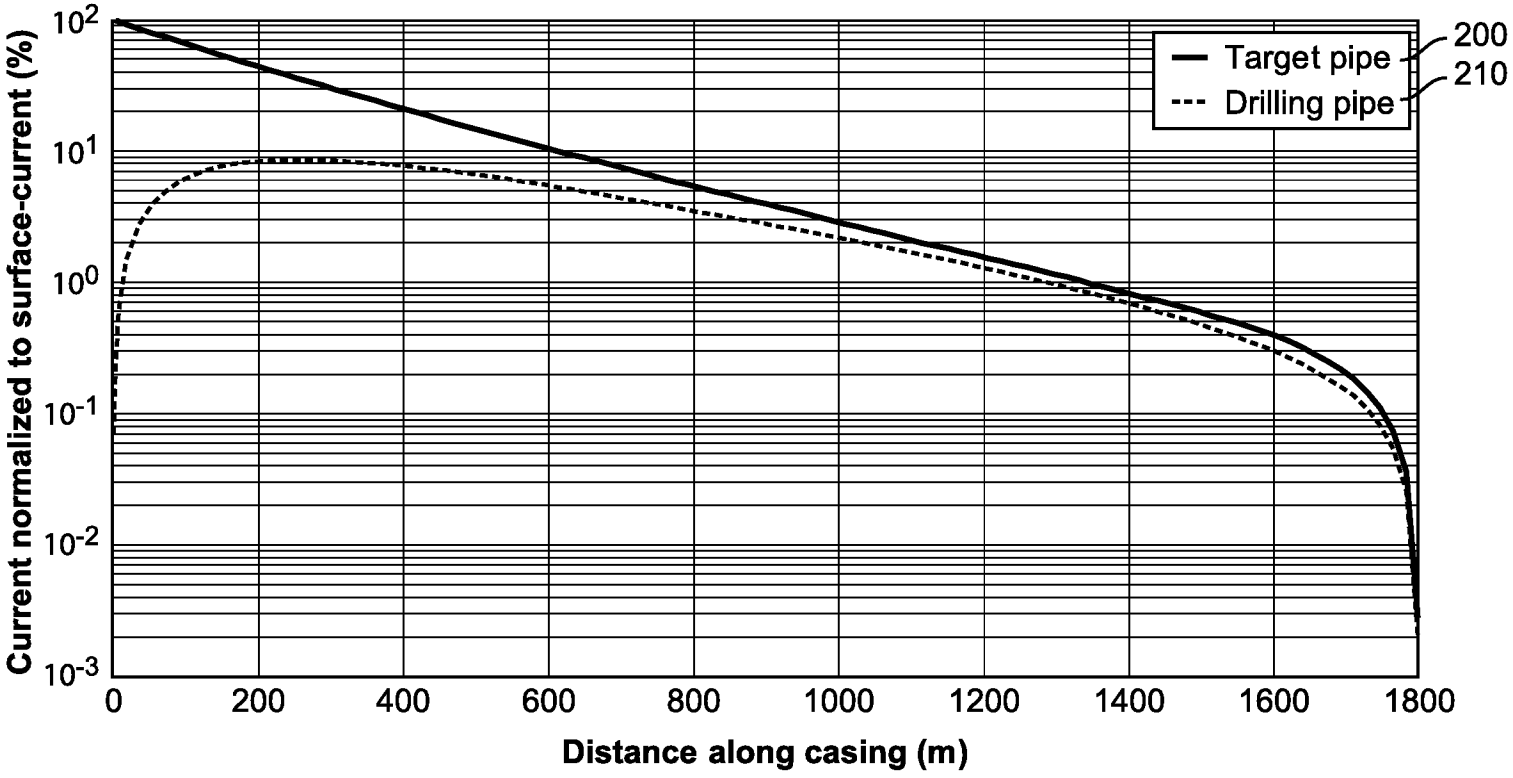
FIG. 3 illustrates a current profile plot along two nearby wells, according to an exemplary embodiment of the present disclosure.

A problem with the surface excitation method is that the current from the producer well can leak out to other conductive bodies. For example, if there are other well casings in near proximity, such as is the case when a second injector well is drilled near a first injector well and a producer well, leakage current on the casing of the first injector well will also generate a magnetic field, thereby affecting the ranging accuracy. FIG. 2 illustrates a modeling example of current leakage between two nearby wells in a conductive medium. As depicted in FIG. 2, two cased wells, target well 200 and drilling well 210, each having a length of 1800 meters are separated by 5 meters. Target well 200 is excited with a 1A surface excitation using a 500 meter remote ground stake. The current profiles along wells 200, 210 were simulated by a 3D full-wave software program using a 10 Ω-m formation resistivity, the results of which are shown in FIG. 3.

FIG. 4 illustrates a second injector well 405 drilled 5 meters above a first injector well 410 and a target well (producing well) 415. If it is assumed that the current profile shown in FIG. 3 is the current profile for the two existing wells, for instance wells 410 and 415 in FIG. 4, and that $I_t$ represents the excited current along the target well 415, $I_g$ is the leakage current along the first injector well 410, and $I_d$ is the leakage current along the new second injector well 405, the total leakage obtained from the current profile plot in FIG. 3, at a chosen depth (MD) of 1000 meters, may be determined by:

$$I_d+I_9=0.67(I_t). \quad (1)$$

Assuming a 20% leakage current, $I_d$, on the new second injector well, and an 80% leakage current, $I_g$, on the older first injector well:

$$I_g=0.67\times0.8\times I_t. \quad (2)$$

The interference H/GH field generated by the first injector well may be calculated according to Equations 3a and 3b, while the ranging distance with interference may be calculated according to Equation 4:

$$\frac{H_g}{H_t}=(I_g/5m)/(I_t/10m); \quad (3a)$$

$$\frac{GH_g}{GH_t}=(I_g/5m^2)/(I_t/10m^2); \quad (3b)$$

$$Dis'=\frac{H_{total}}{GH_{total}}=\frac{H_t+H_g}{GH_t+GH_g}=0.658Dis; \quad (4)$$

where $H_g$ is the magnetic field generated by the new second injector well and $H_t$ is the magnetic field generated by the target well. As shown in Eq. 4, the ranging distance with interface is approximately two thirds of the true distance. Therefore, a large error in ranging distance determination may result from the leakage current in the nearby well. An advantage of the presently disclosed ranging method is that the leakage current effect is taken into consideration.

FIG. 5 illustrates a SAGD drilling operating environment 500 according to an illustrative embodiment of the present disclosure. As depicted in FIG. 5, a producer well (target well) 510 has been drilled through one or more rock formations. FIG. 5 also depicts an existing first injector well (ghost well) 520 that may be aged, failed, or otherwise rendered inefficient or ineffective to carry out the SAGD process. As a result, a design path 530 for a new second injector well to replace the first injector well may be determined. The design path 530 for the second injector well cannot be too distant from the producer well 510 or heating during the SAGD process will be too inefficient. The design path 530 for the second injector well may be designed to be in the same vertical plane as the producer well 510 and the first injector well 520. In such cases, the distance, D, between the producer well 510 and the first injector well 520 may be, for instance, 5-6 meters, and the design path 530 for the second injector well may be designed to be, for instance, spaced 8 meters apart from the producer well 510.

Survey data corresponding to the producer well 510, as well as the casing/pipe structure and material of the producer well 510 may be known in advance of determining the design path 530 for the second injector well. Additionally, when a standard magnetic ranging with surface excitation technique is used to drill the first injector well, the current profile along the producer well can be obtained from the magnetic field H measured at the ranging sensor and its derived ranging distance Dis, according to Eqn. 5:

$$I=2\pi\cdot\mathrm{Dis}\cdot H. \quad (5)$$

An inversion algorithm may be employed to estimate the surrounding formation resistivity and casing property profile along the producer well from the current profile obtained according to Eqn. 5. The inversion algorithm may include inversion, with a forward modeling engine, of the current profile obtained along a casing with known length in order to determine at least one of the casing conductivity, casing permeability, casing diameter, and formation resistivity.

A current leakage profile may be used in place of the current profile to determine the formation resistivity and casing property profile along the produce well. In some instances, the current leakage profile may be determined from the magnetic ranging measurements. Alternatively, the current leakage profile may be determined from the current profile. For instance, the current leakage profile may be determined as the derivative of the current profile along the well dimension. After obtaining the current leakage rate profile, the current leakage profile may then be matched to modeled or known leakage rate curves to estimate the formation resistivity surrounding the wellbore.

The trajectory and design path 530 of the second injection well can be designed as shown in FIG. 5 using the available survey information for the producer well 510 and the first injector well 520. At each depth in the test plan, a three well model may be built that includes the trajectory data for each well, as shown in FIG. 5. The three well model, along with the formation resistivity and casing property profile obtained from the inversion algorithm, may be used as input to a forward modeling engine to simulate the three-well model. The resulting magnetic field may be output by the forward modeling engine as a reference look-up table of 3D coordinates in the region surrounding the sensor. The forward modeling may be carried out for each depth in the test plan since the drilling pipe length affects the current and magnetic field distribution.

Figure 10:
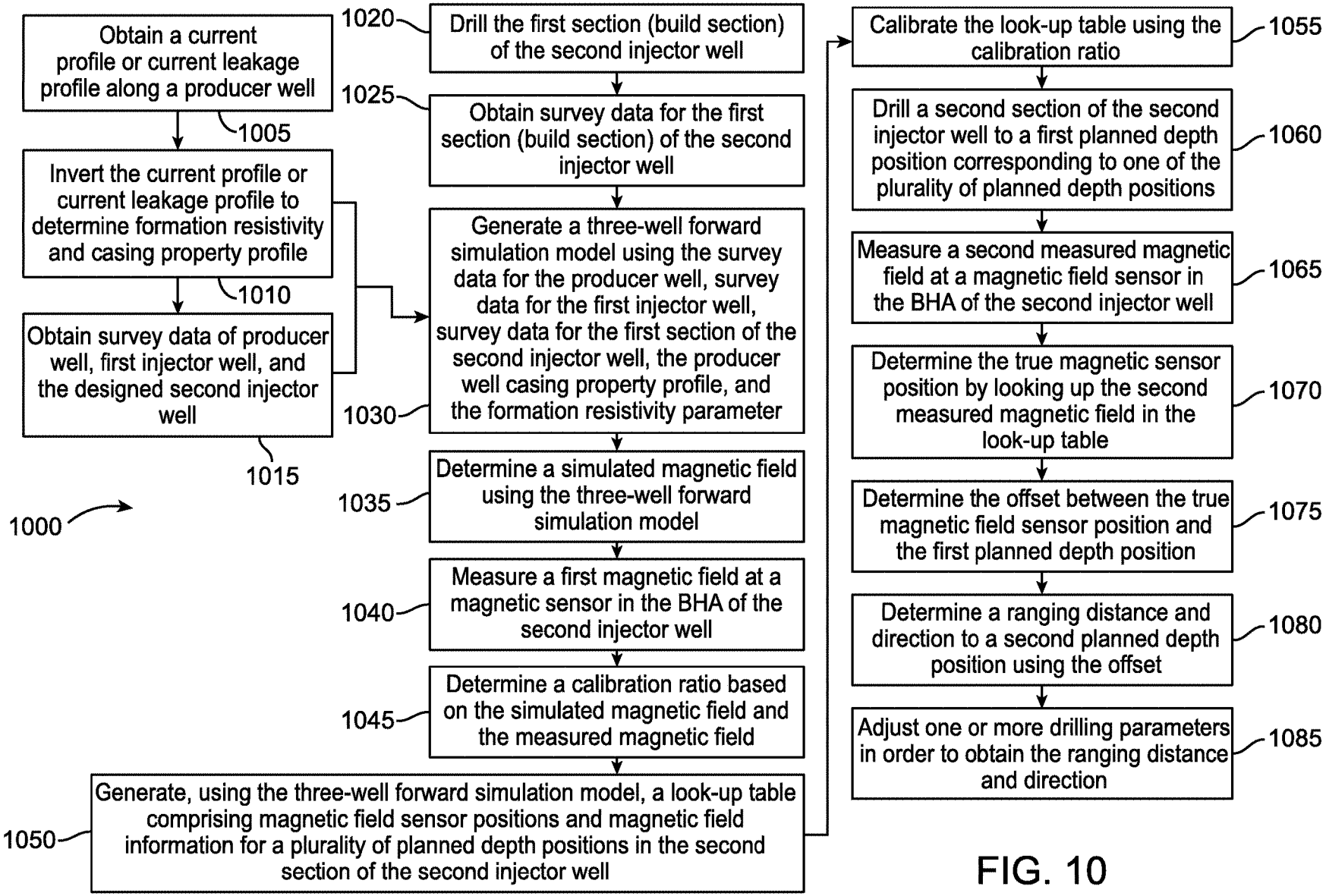
FIG. 10 illustrates a flowchart depicting a method for second injector well planning following the drilling of the build section of the second injector well but prior to commencement of drilling the reservoir section of the second injector well, according to an exemplary embodiment of the present disclosure.
Figure 11:
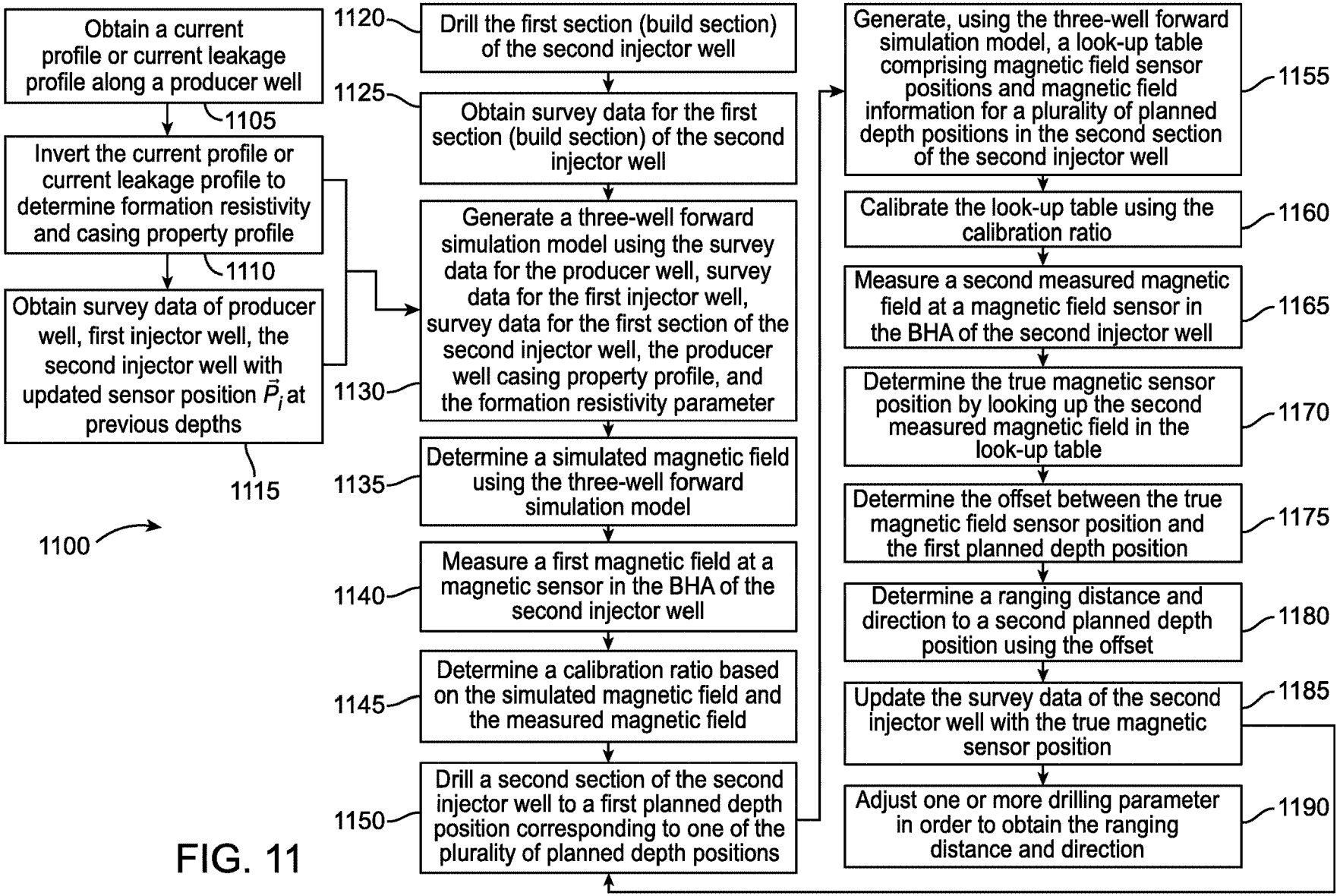
FIG. 11 illustrates a flowchart depicting a method for second injector well planning during the drilling of the second section of the second injector well, according to an exemplary embodiment of the present disclosure.

The methods of the present disclosure, including but not limited to, generating the design path of the second injection well, generating the three-well forward simulation model, as well as the methods described in FIGS. 10 and 11, may be carried out, in whole or in part, by computing devices located at the surface or located in the BHA of the second injector well, such as computing devices 150, 155, depicted in FIG. 1.

Figure 6A:
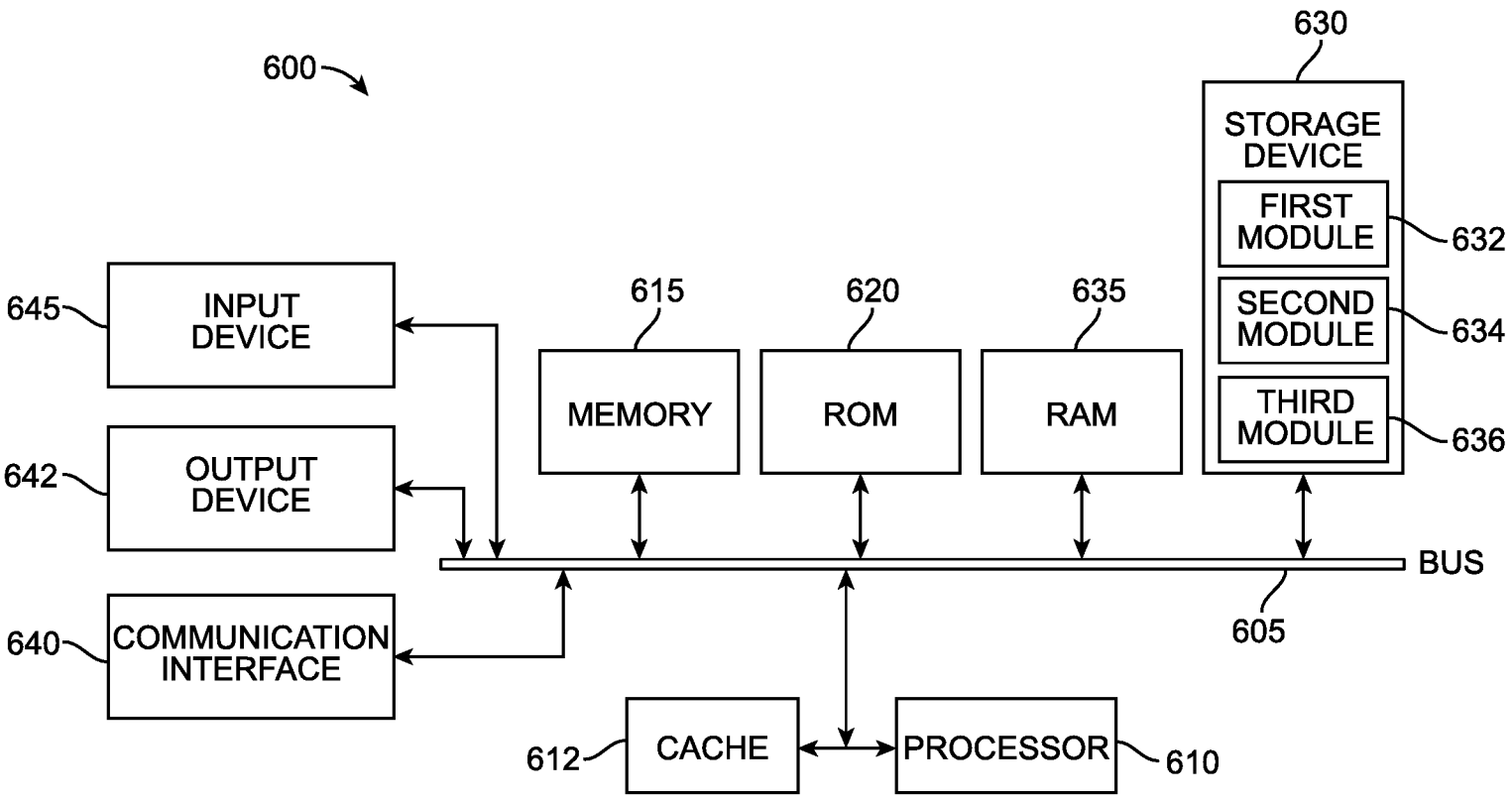
FIG. 6A is an illustration depicting a conventional system bus computing system architecture, according to an exemplary embodiment of the present disclosure.
Figure 6B:
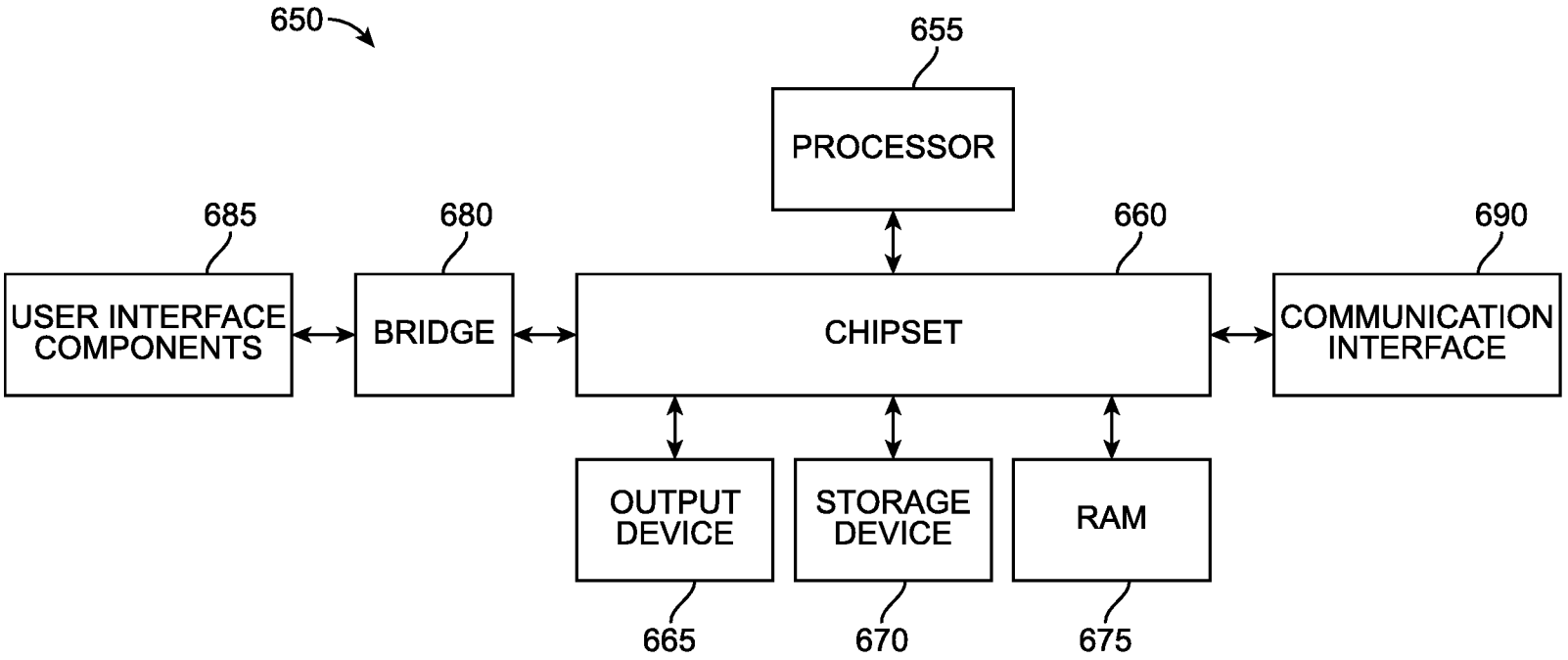
FIG. 6B is an illustration depicting a computer system having a chipset architecture, according to an exemplary embodiment of the present disclosure.

Computing devices 150 and 155 may include any suitable computer, controller, or data processing apparatus capable of being programmed to carry out the method, system, and apparatus as further described herein. FIGS. 6A and 6B illustrate exemplary computing device 150, 155 embodiments which can be employed to practice the concepts, methods, and techniques disclosed herein. The more appropriate embodiment will be apparent to those of ordinary skill in the art when practicing the present technology. Persons of ordinary skill in the art will also readily appreciate that other system embodiments are possible.

FIG. 6A illustrates a conventional system bus computing system architecture 600 wherein the components of the system are in electrical communication with each other using a bus 605. System 600 can include a processing unit (CPU or processor) 610 and a system bus 605 that couples various system components including the system memory 615, such as read only memory (ROM) 620 and random access memory (RAM) 635, to the processor 610. The system 600 can include a cache of high-speed memory connected directly with, in close proximity to, or integrated as part of the processor 610. The system 600 can copy data from the memory 615 and/or the storage device 630 to the cache 612 for quick access by the processor 610. In this way, the cache 612 can provide a performance boost that avoids processor 610 delays while waiting for data. These and other modules can control or be configured to control the processor 610 to perform various actions. Other system memory 615 may be available for use as well. The memory 615 can include multiple different types of memory with different performance characteristics. It can be appreciated that the disclosure may operate on a computing device 600 with more than one processor 610 or on a group or cluster of computing devices networked together to provide greater processing capability. The processor 610 can include any general purpose processor and a hardware module or software module, such as first module 632, second module 634, and third module 636 stored in storage device 630, configured to control the processor 610 as well as a special-purpose processor where software instructions are incorporated into the actual processor design. The processor 610 may essentially be a completely self-contained computing system, containing multiple cores or processors, a bus, memory controller, cache, etc. A multi-core processor may be symmetric or asymmetric.

The system bus 605 may be any of several types of bus structures including a memory bus or a memory controller, a peripheral bus, and a local bus using any of a variety of bus architectures. A basic input/output (BIOS) stored in ROM 620 or the like, may provide the basic routine that helps to transfer information between elements within the computing device 600, such as during start-up. The computing device 300 further includes storage devices 630 or computer-readable storage media such as a hard disk drive, a magnetic disk drive, an optical disk drive, tape drive, solid-state drive, RAM drive, removable storage devices, a redundant array of inexpensive disks (RAID), hybrid storage device, or the like. The storage device 630 can include software modules 632, 634, 636 for controlling the processor 610. The system 600 can include other hardware or software modules. The storage device 630 is connected to the system bus 605 by a drive interface. The drives and the associated computer-readable storage devices provide non-volatile storage of computer-readable instructions, data structures, program modules and other data for the computing device 600. In one aspect, a hardware module that performs a particular function includes the software components shorted in a tangible computer-readable storage device in connection with the necessary hardware components, such as the processor 610, bus 605, and so forth, to carry out a particular function. In the alternative, the system can use a processor and computer-readable storage device to store instructions which, when executed by the processor, cause the processor to perform operations, a method or other specific actions. The basic components and appropriate variations can be modified depending on the type of device, such as whether the device 600 is a small, handheld computing device, a desktop computer, or a computer server. When the processor 610 executes instructions to perform "operations", the processor 610 can perform the operations directly and/or facilitate, direct, or cooperate with another device or component to perform the operations.

To enable user interaction with the computing device 600, an input device 645 can represent any number of input mechanisms, such as a microphone for speech, a touch-sensitive screen for gesture or graphical input, keyboard, mouse, motion input, speech and so forth. An output device 642 can also be one or more of a number of output mechanisms known to those of skill in the art. In some instances, multimodal systems can enable a user to provide multiple types of input to communicate with the computing device 600. The communications interface 640 can generally govern and manage the user input and system output. There is no restriction on operating on any particular hardware arrangement and therefore the basic features here may easily be substituted for improved hardware or firmware arrangements as they are developed.

Storage device 630 is a non-volatile memory and can be a hard disk or other types of computer readable media which can store data that are accessible by a computer, such as magnetic cassettes, flash memory cards, solid state memory devices, digital versatile disks (DVDs), cartridges, RAMs 625, ROM 620, a cable containing a bit stream, and hybrids thereof.

The logical operations for carrying out the disclosure herein may include: (1) a sequence of computer implemented steps, operations, or procedures running on a programmable circuit with a general use computer, (2) a sequence of computer implemented steps, operations, or procedures running on a specific-use programmable circuit; and/or (3) interconnected machine modules or program engines within the programmable circuits. The system 600 shown in FIG. 6A can practice all or part of the recited methods, can be a part of the recited systems, and/or can operate according to instructions in the recited tangible computer-readable storage devices.

One or more parts of the example computing device 600, up to and including the entire computing device 600, can be virtualized. For example, a virtual processor can be a software object that executes according to a particular instruction set, even when a physical processor of the same type as the virtual processor is unavailable. A virtualization layer or a virtual "host" can enable virtualized components of one or more different computing devices or device types by translating virtualized operations to actual operations. Ultimately however, virtualized hardware of every type is implemented or executed by some underlying physical hardware. Thus, a virtualization compute layer can operate on top of a physical compute layer. The virtualization compute layer can include one or more of a virtual machine, an overlay network, a hypervisor, virtual switching, and any other virtualization application.

The processor 610 can include all types of processors disclosed herein, including a virtual processor. However, when referring to a virtual processor, the processor 610 includes the software components associated with executing the virtual processor in a virtualization layer and underlying hardware necessary to execute the virtualization layer. The system 600 can include a physical or virtual processor 610 that receives instructions stored in a computer-readable storage device, which causes the processor 610 to perform certain operations. When referring to a virtual processor 610, the system also includes the underlying physical hardware executing the virtual processor 610.

FIG. 6B illustrates an example computer system 650 having a chipset architecture that can be used in executing the described method and generating and displaying a graphical user interface (GUI). Computer system 650 can be computer hardware, software, and firmware that can be used to implement the disclosed technology. System 650 can include a processor 655, representative of any number of physically and/or logically distinct resources capable of executing software, firmware, and hardware configured to perform identified computations. Processor 655 can communicate with a chipset 660 that can control input to and output from processor 655. Chipset 660 can output information to output device 665, such as a display, and can read and write information to storage device 670, which can include magnetic media, and solid state media. Chipset 660 can also read data from and write data to RAM 675. A bridge 680 for interfacing with a variety of user interface components 685 can include a keyboard, a microphone, touch detection and processing circuitry, a pointing device, such as a mouse, and so on. In general, inputs to system 650 can come from any of a variety of sources, machine generated and/or human generated.

Chipset 660 can also interface with one or more communication interfaces 690 that can have different physical interfaces. Such communication interfaces can include interfaces for wired and wireless local area networks, for broadband wireless networks, as well as personal area networks. Some applications of the methods for generating, displaying, and using the GUI disclosed herein can include receiving ordered datasets over the physical interface or be generated by the machine itself by processor 655 analyzing data stored in storage 670 or RAM 675. Further, the machine can receive inputs from a user via user interface components 685 and execute appropriate functions, such as browsing functions by interpreting these inputs using processor 655.

It can be appreciated that systems 600 and 650 can have more than one processor 610, 655 or be part of a group or cluster of computing devices networked together to provide processing capability. For example, the processor 610, 655 can include multiple processors, such as a system having multiple, physically separate processors in different sockets, or a system having multiple processor cores on a single physical chip. Similarly, the processor 610 can include multiple distributed processors located in multiple separate computing devices, but working together such as via a communications network. Multiple processors or processor cores can share resources such as memory 615 or the cache 612, or can operate using independent resources. The processor 610 can include one or more of a state machine, an application specific integrated circuit (ASIC), or a programmable gate array (PGA) including a field PGA.

Methods according to the aforementioned description can be implemented using computer-executable instructions that are stored or otherwise available from computer readable media. Such instructions can comprise instructions and data which cause or otherwise configured a general purpose computer, special purpose computer, or special purpose processing device to perform a certain function or group of functions. portions of computer resources used can be accessible over a network. The computer executable instructions may be binaries, intermediate format instructions such as assembly language, firmware, or source code. Computer-readable media that may be used to store instructions, information used, and/or information created during methods according to the aforementioned description include magnetic or optical disks, flash memory, USB devices provided with non-volatile memory, networked storage devices, and so on.

For clarity of explanation, in some instances the present technology may be presented as including individual functional blocks including functional blocks comprising devices, device components, steps or routines in a method embodied in software, or combinations of hardware and software. The functions these blocks represent may be provided through the use of either shared or dedicated hardware, including, but not limited to, hardware capable of executing software and hardware, such as a processor 610, that is purpose-built to operate as an equivalent to software executing on a general purpose processor. For example, the functions of one or more processors represented in FIG. 6A may be provided by a single shared processor or multiple processors. (use of the term "processor" should not be construed to refer exclusively to hardware capable of executing software.) Illustrative embodiments may include microprocessor and/or digital signal processor (DSP) hardware, ROM 620 for storing software performing the operations described below, and RAM 635 for storing results. Very large scale integration (VLSI) hardware embodiments, as well as custom VLSI circuitry in combination with a general purpose DSP circuit, may also be provided.

The computer-readable storage devices, mediums, and memories can include a cable or wireless signal containing a bit stream and the like. However, when mentioned, non-transitory computer-readable storage media expressly exclude media such as energy, carrier signals, electromagnetic waves, and signals per se.

Devices implementing methods according to these disclosures can comprise hardware, firmware and/or software, and can take any of a variety of form factors. Such form factors can include laptops, smart phones, small form factor personal computers, personal digital assistants, rackmount devices, standalone devices, and so on. Functionality described herein also can be embodied in peripherals or add-in cards. Such functionality can also be implemented on a circuit board among different chips or different processes executing in a single device.

The instructions, media for conveying such instructions, computing resources for executing them, and other structures for supporting such computing resources are means for providing the functions described in the present disclosure.

FIG. 7 illustrates a ranging procedure for drilling a second injection well according to an illustrative embodiment of the present disclosure. As depicted in FIG. 7, a producer well 715 has been drilled and coupled with a current source 710 which is in turn coupled to a ground stake 705. The current source 710 is capable of carrying out the surface excitation method by injecting a current into the casing of the producer well 715. FIG. 7 also depicts a first injector well 720 and a second injector well 725 adjacent to the producer well 715.

First, the first (build) section 726 (between points "A" and "B") of the second injector well 725 may be drilled without ranging since the separation between the build section 726 of the second injector well 725 and the producer well 715 is not critical. Additionally, the survey data in the first (build) section 726 tends to be more accurate than the survey data in subsequent drilling depths.

At the end 735 (MD0) of the first (build) section 726 (point "B"), the first three-well model is built using the survey coordinates from the build section 728 and the survey coordinates from the first injector well 720 and the producer well 715. The forward simulation is carried out using the formation resistivity and casing properties, and the simulated magnetic field H1(B) is determined at the MWD magnetic sensor in the bottomhole assembly (BHA) at the end of the drill string in the second injector well 725.

At the end 735 (MD0) of the first (build) section 726, the magnetic sensor installed in the BHA also measures the magnetic field H2(B). Since the build section just finished, the survey data at 735 (point B) is still accurate. Therefore, the measured magnetic field H2(B) may be used to calibrate the simulated magnetic field H1(B) by determining a calibration ratio R. The drilling of the subsequent second section 728 of the second injector well 725 will be predominantly through the reservoir region which has relatively uniform properties. Therefore, the calibration ration R may be used to calibrate the magnetic field at subsequent depths in the second section 728.

Figure 8:
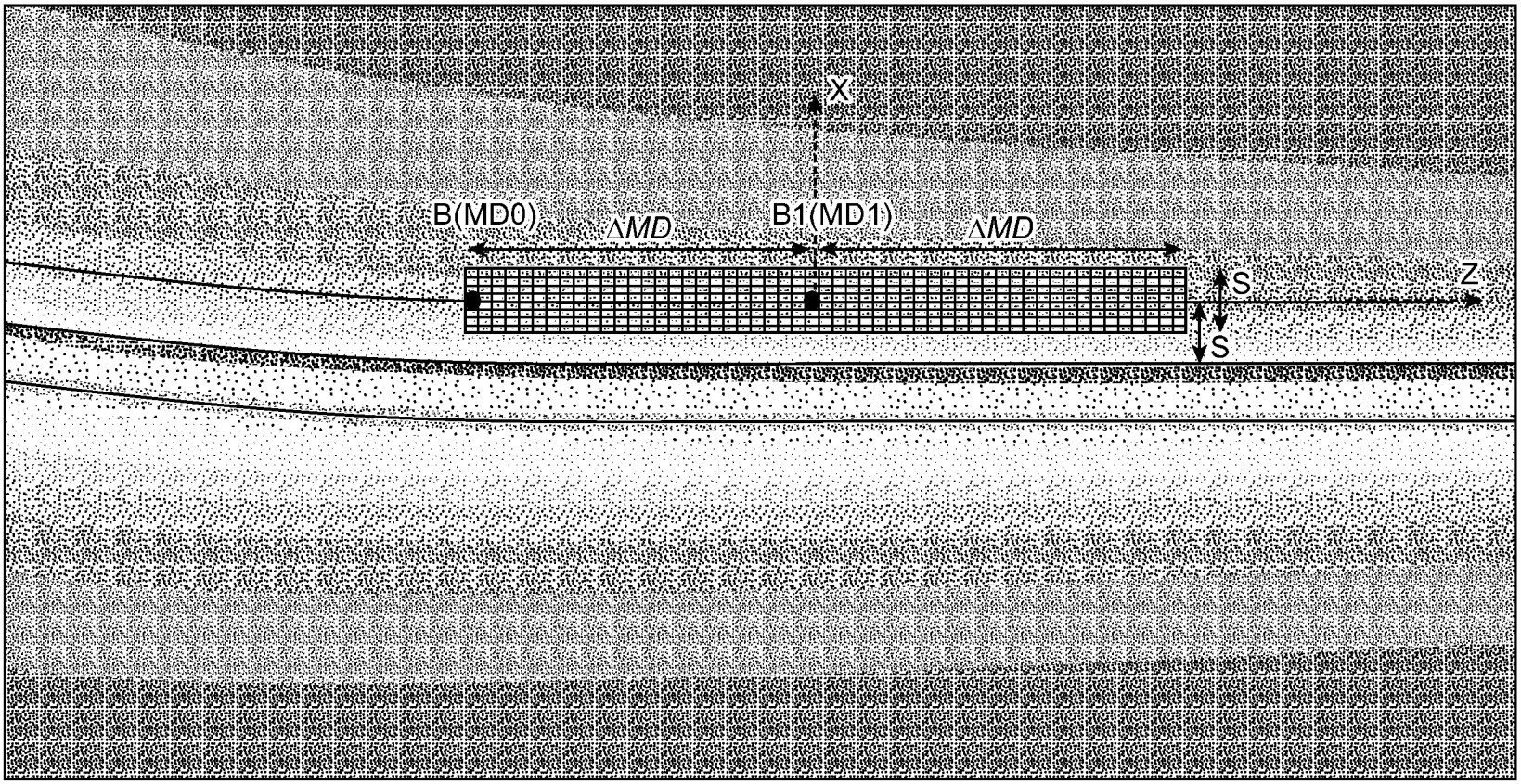
FIG. 8 illustrates a look-up table, according to an exemplary embodiment of the present disclosure.

The second section 728 of the drilling of the second injector well 725 may be sequentially planned at each depth by carrying out the simulation and outputting the magnetic field to 3D coordinates in the interested region around the MWD magnetic sensor in the BHA. For instance, for each depth along the designed lateral path, such as MD1 at point B1, the pipe consists of the existing first (build) section 726 and the planned second section is used to build the planner model at MD1. In such instance, the magnetic field is output to 3D coordinates in the interested region around the MWD magnetic sensor in the BHA, as shown in FIG. 8. As shown in FIG. 8, an interested region with certain length along pipe (normally one pipe section length) and width/depth (determined by ranging distance desired) is meshed into uniform grids. The meshing size is determined by the signal changing rate. The H-field is simulated for each grid points and a look-up table between H-field and grid position is formed.

The previously described process is repeated for each depth in the test plan MD2, MD3, . . . , MDN. After running the forward modeling engine N times for all planned depths, a look-up library in the format of $[MD_i, \vec{P}, \vec{H}]$ may be generated, where $\vec{P}$ is the position of grid points in the interested region with the well head as a reference. The look-up table may be calibrated according to the calibration ratio R calculated previously at the end of the build section (point "B").

Upon completion of the well-planning process and generation of the look-up table, the drilling of the second section 728 of the second injector well may commence. The drilling of the second portion of the second injector well will follow the designed path. Deviations in the drilling may be adjusted using the look-up table.

During the real-time drilling of the second section 730 of the second injector well, the magnetic field H is measured by the magnetic field sensor installed in the BHA of the drill pipe for each design depth, such as MD1 (B1). The measured magnetic field H is searched in the look-up library generated by the well planner. The coordinates of the BHA magnetic sensor (P1) are obtained from the mapping relation between $\vec{P}$ and $\vec{H}$. The coordinates of the BHA magnetic sensor should be near the designed position (B1) with some offsets. The ranging distance and direction can be calculated from the designed position with those offsets. The drilling direction may be adjusted according to the determined offsets.

Figure 9:
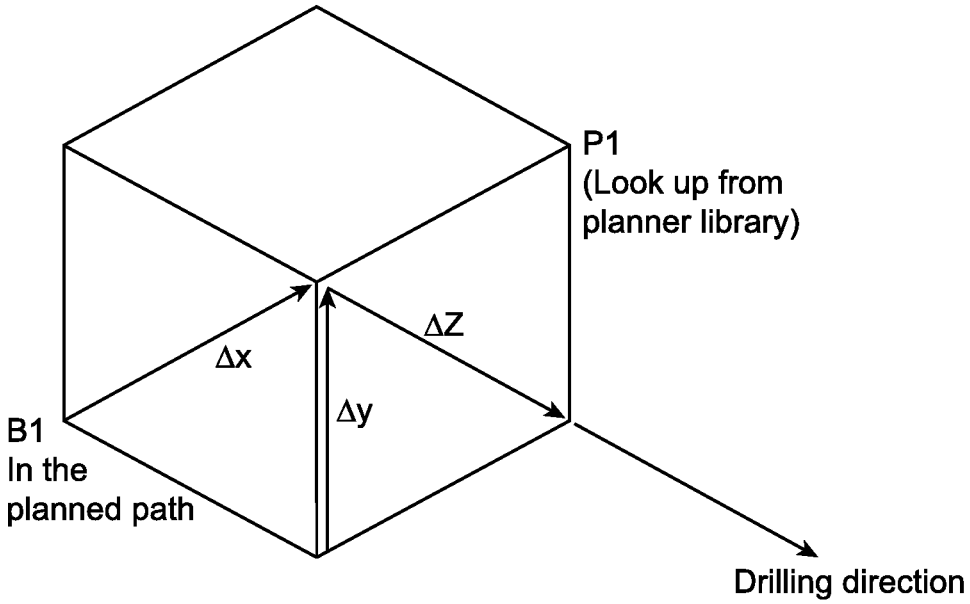
FIG. 9 illustrates a relationship between the true sensor position (P1) and the planned sensor position (B1) during the drilling of a second injection well, according to an exemplary embodiment of the present disclosure.

FIG. 9 illustrates a relationship between the true sensor position (P1) and the planned sensor position (B1) during the drilling of a second injection well, according to an illustrative embodiment of the present disclosure. As depicted in FIG. 9, if $\overrightarrow{H_1}$ is measured at MD1, MD1 and $\overrightarrow{H_1}$ are used to search the planner library and locate the true sensor position $\overrightarrow{P_1}$. If Δx, Δy, and Δz represent the offsets along the three axes between the true sensor position (P1) and the planned path position (B1), the ranging distance and direction may be obtained by:

$$Dis = \sqrt{((S + \Delta y)^2 + \Delta x^2)} \tag{6}$$

$$Dir = \arctan\left(\frac{\Delta x}{S + \Delta y}\right) \tag{7}$$

The drill bit may be steered back to the design path by adjusting the drilling direction based on the offsets obtained in Eqns. 6 and 7, according to:

$$\text{Change in Inclination: } \Delta\theta = \arctan\left(\frac{-\Delta y}{\Delta MD}\right) \tag{8}$$

-continued $$\text{Change in Azmuth: } \Delta\phi = \arctan\left(\frac{-\Delta x}{\Delta MD}\right) \tag{9}$$

After obtaining the ranging distance and direction at MD1 and the respective drilling path adjustments, the second injector well survey must be updated at MD1 since the original survey would not be accurate along the design path in the reservoir section. Specifically, the second injector well survey may be updated by replacing B1 in the design path trajectory with Position P1.

According to at least one aspect of the present disclosure, the planner may be run in real time during drilling before each ranging survey. In this way, the true second injector well trajectory P1 can be used in the model for the next depth and a more accurate magnetic field H and respective look-up table may be generated.

Referring to FIG. 10, a flowchart is presented in accordance with exemplary embodiment. The exemplary method shown in FIG. 10 is provided by way an illustrative embodiment, as there are a variety of ways to carry out the presently disclosed method. Each block shown in FIG. 10 represents one or more process, methods, or subroutines, carried out in the exemplary method shown in FIG. 10. Furthermore, the illustrated order of blocks is illustrative only and the order of the blocks can change according to the present disclosure. Additional blocks may be added or fewer blocks can be utilized, without departing from the present disclosure.

The exemplary method 1000 depicted in FIG. 10 includes second injector well planning following the drilling of the build section of the second injector well but prior to commencement of drilling the reservoir section of the second injector well. The exemplary method 1000 may begin at block 1005. At block 1005, the current profile or current leakage profile along a producer well is obtained. The current profile or the current leakage profile for the producer well may be obtained, for example, from the ranging results or data obtained during the use of a magnetic ranging with surface excitation ranging technique to drill a previous injector well, such as a first injector well. At block 1010, the current profile or current leakage profile is inverted using an inversion algorithm to determine a casing property profile and an estimate of the resistivity of the surrounding formation. The casing property profile may include one or more of the producer well casing conductivity, producer well casing permeability, and the producer well casing diameter.

In at least some instances, the current profile may be calculated from the current leakage profile using integration along the depth axis. Additionally, the current leakage profile may be calculated from the current profile using differentiation along the depth axis.

At block 1015, survey data of the producer well and the first injector well are obtained. The survey data may include MWD data obtained during the drilling of the producer well and the first injector well. Survey data for the second injector well may also be obtained at block 1015. Survey data for the second injector well may include MWD data obtained during the drilling of the build section of the second injector well and may also include the design path information for the second injector well.

At block 1020, the first section (build section) of the second injector well is drilled. The first section (build section) of the second injector well may be drilled without ranging as the spacing of the build section relative to the producer well is not critical for efficient SAGD recovery. At block 1025, survey data for the first section (build section) of the second injector well is obtained.

At block 1030, a three-well forward simulation model is generated using the survey data for the producer well, the survey data for the first injector well, the survey data for the first section of the second injector well, the producer well casing property profile, and the formation resistivity parameter. The casing property profile may include one or more of the producer well casing conductivity, producer well casing permeability, and the producer well casing diameter. At block 1035, a simulated magnetic field is determined using the three-well forward simulation model. At block 1040, a first magnetic field is measured at a magnetic sensor in the BHA of the second injector well. A calibration ratio, R, is determined at block 1045 based on the simulated magnetic field and the measured magnetic field.

At block 1050, a look-up table $[MD_i, \vec{P}, \overrightarrow{H_1}]$ comprising magnetic field sensor positions and magnetic field information for a plurality of planned depth positions $MD_i$ in the second section of the second injector well is generated using the three-well forward simulation model. The look-up table is calibrated using the calibration ratio, R, at block 1055.

As used herein, the term "second section" refers to the section of the second injector wellbore drilled after drilling the first section (build section) portion of the second injector well. In at least some instances, the "second section refers" to a section of the second injector well corresponding to one or more of a plurality of planned depths having a ranging distance from the producer well sufficient to carry out the SAGD recovery method. In at least some instances, the second section comprises the substantially lateral portion of the second injector wellbore following the substantially vertical build section of the second injector well. The spacing of the second section of the second injector well relative to the producer well is critical for efficient SAGD recovery of hydrocarbons.

At block 1060, the second section of the second injector well is drilled to a first planned depth position $MD_1$ corresponding to one of the plurality of planned depth positions. At block 1065, a second measured magnetic field is measured at a magnetic field sensor in the BHA of the second injector well. The true magnetic sensor position $\vec{P}$ is determined by looking up the second measured magnetic field in the look-up table, at block 1070. At block 1075, the offset between the true magnetic field sensor position $\vec{P}$ and the first planned depth position is determined. At block 1080, a ranging distance and direction to a second planned depth position is determined using the offset. One or more drilling parameters is adjusted, at block 1085, in order to obtain the ranging distance and direction. The adjusting of one or more drilling parameters may include adjusting the inclination and the azimuth of the drill bit.

In at least some instances, block 1060 to block 1085 may be repeated for each planned depth position $MD_i$. In such instances, block 1060 may include drilling a second section of the second injector well to a second planned depth position, a third planned depth position, or any number of the plurality of planned depth positions, in iterative fashion, such that the presently disclosed ranging method may be used to drill the second section of the second injector well with respect to all planned depths.

In at least some instances, any one of blocks 1005, 1010, 1015, and 1025 may be performed prior to the drilling of the build section of the second injector well at block 1020. Further, the exemplary method 1000 may be applied to the drilling of any subsequent injector well to replace or augment a first injector well. For instance, the exemplary method 1000 may be performed for a second injector well, third injector well, a fourth injector well, or any number of injector wells. In each case the survey data at block 1015 would include survey data for each previous injector well as well as the survey data for the designed new well. Additionally, the three-well model at block 1030 may become a four-well model, or any number of well model, as needed to permit the presently disclosed method to be used to range or plan the drilling of any particular injector well drilled subsequent to the first injector well.

The exemplary method 1100 depicted in FIG. 11 includes second injector well planning during the drilling of the second section of the second injector well. The exemplary method 1100 may begin at block 1105. At block 1105, the current profile or current leakage profile along a producer well is obtained. The current profile or current leakage profile for the producer well may be obtained, for example, from the ranging results or data obtained during the use of a magnetic ranging with surface excitation ranging technique to drill a previous injector well, such as a first injector well. At block 1110, the current profile or current leakage profile is inverted using an inversion algorithm to determine a casing property profile and an estimate of the resistivity of the surrounding formation. The casing property profile may include one or more of the producer well casing conductivity, producer well casing permeability, and the producer well casing diameter.

At block 1115, survey data of the producer well and the first injector well are obtained. The survey data may include MWD data obtained during the drilling of the producer well and the first injector well. Survey data for the second injector, including the updated sensor position P; at previous depths, is also obtained at block 1115. Survey data for the second injector well may include MWD data obtained during the drilling of the build section of the second injector well and may also include the design path information for the second injector well. The survey data of the second injector well is updated iteratively with the true magnetic sensor position, according to block 1185, during the drilling of the second section of the second injector well.

At block 1120, the first section (build section) of the second injector well is drilled. The first section (build section) of the second injector well may be drilled without ranging as the spacing of the build section relative to the producer well is not critical for efficient SAGD recovery. At block 1125, survey data for the first section (build section) of the second injector well is obtained.

At block 1130, a three-well forward simulation model is generated using the survey data for the producer well, the survey data for the first injector well, the survey data for the second injector well including updated sensor positions $\vec{P}_i$ at previous depths, the producer well casing property profile, and the formation resistivity parameter. The casing property profile may include one or more of the producer well casing conductivity, producer well casing permeability, and the producer well casing diameter. At block 1135, a simulated magnetic field is determined using the three-well forward simulation model. At block 1140, a first magnetic field is measured at a magnetic sensor in the BHA of the second injector well. A calibration ratio, R, is determined at block 1145 based on the simulated magnetic field and the measured magnetic field.

At block 1150, the second section of the second injector well is drilled to a first planned depth position $MD_1$ corresponding to one of the plurality of planned depth positions. As depicted in FIG. 11, block 1150 may be repeated iteratively for each subsequent planned depth $MD_1$ until each of the planned plurality of depth positions in the designed second injector well is drilled.

At block 1155, a look-up table $[MD_i, \vec{P}, \vec{H}]$ comprising magnetic field sensor positions and magnetic field information for a plurality of planned depth positions $MD_i$ in the second section of the second injector well is generated using the three-well forward simulation model. The look-up table is calibrated using the calibration ratio, R, at block 1160. At block 1165, a second measured magnetic field is measured at a magnetic field sensor in the BHA of the second injector well. The true magnetic sensor position $\vec{P}$ is determined by looking up the second measured magnetic field in the look-up table, at block 1170. At block 1175, the offset between the true magnetic field sensor position $\vec{P}$ and the first planned depth position is determined. At block 1180, a ranging distance and direction to a second planned depth position is determined using the offset.

At block 1185, the survey data of the second injector well is updated with the true magnetic sensor position. Blocks 1150 to 1185 are subsequently repeated in iterative fashion for each planned depth position $MD_i$. In each iteration, a new look-up table based at least in part on the updated magnetic field sensor positions, is generated at block 1155.

At block 1190, one or more drilling parameters is adjusted in order to obtain the ranging distance and direction. The adjusting of one or more drilling parameters may include adjusting the inclination and the azimuth of the drill bit.

The exemplary method 1100 may be applied to the drilling of any subsequent injector well to replace or augment a first injector well. For instance, the exemplary method 1100 may be performed for a second injector well, third injector well, a fourth injector well, or any number of injector wells. In each case the survey data at block 1115 would include survey data for each previous injector well as well as the survey data for the designed new well. Additionally, the three-well model at block 1130 may become a four-well model, or any number of well model, as needed to permit the presently disclosed method to be used to range or plan the drilling of any particular injector well drilled subsequent to the first injector well.

According to at least one aspect of the present disclosure, a method is provided. The method includes obtaining magnetic ranging measurements between a first injector well and a producer well; determining a current profile or a current leakage profile along the producer well using the magnetic ranging measurements; determining a producer well casing property profile and a formation resistivity parameter from the current profile or current leakage profile along the producer well; drilling a first section of a second injector well; and determining the position of the second injector well with respect to the first injector well and the producer well using the producer well casing property profile and the formation resistivity parameter.

The method may further include determining, at a magnetic sensor in the bottomhole assembly (BHA) of the second injector well, a magnetic sensor position; updating the survey data of the second injector well using the magnetic sensor position; and determining the position of the second injector well with respect to the first injector well and the producer well using the updated survey data.

In at least some instances, the current profile or current leakage profile can be determined for a bottomhole assembly (BHA) conductive body in the first injector well. The BHA conductive body may be, for instance, a BHA collar. In some cases, the determining the current profile or the current leakage profile includes the use of magnetic ranging measurements which include a magnetic field generated by leakage current on a casing of the first injector well.

In some instances, the method may further include determining a current leakage rate from a current profile or current leakage profile comprising a BHA conductive body in the first injector well. In such instances, the current leakage rate may be used to determine a formation resistivity parameter. In at least some instances, the second injector BHA current leakage rate may be assumed to be the same as the first injector BHA current leakage rate in generating the three-well forward simulation model using the survey data for the producer well, survey data for the first injector well, survey data for the first section of the second injector well, the producer well casing property profile, and the formation resistivity parameter.

The current profile along a conductive pipe (presenting a BHA configuration in a LWD/MWD drilling well) may be determined by applying surface excitation to the wellhead of the well. For instance, the operating frequency may be 5 Hz, the target well length may be 1800 meters and the casing conductivity may be 106 S. The slope of the current profile may be defined by:

$$\text{Slope} = \log10\left(\frac{\log 10(I(i)) - \log 10(I(i-1))}{MD(i) - MD(i-1)}\right) \tag{10}$$

where i represents a depth index along a drill string, I(i) is the amplitude of the current signal as measured or detected at the depth index i, MD(i) represents measured depth or a well casing at the depth index i. The current leakage rate (slope) in a homogeneous formation, when away from termination of pipe, surface and return electrode, can be calculated simply by using the following formula:

$$I(z) = \exp\left(-z\sqrt{\frac{Rpipe}{Rf}}\right) \tag{11}$$

where z is the measured depth of the well, $R_{pipe}$ is the resistance per unit length of the pipe, Rf is the formation resistivity and I(z) is the current magnitude as a function of measured depth. Consequently, to determine the formation resistivity by using the current leakage rate of the current profile along the target well, it is only applicable when the current signal is far away from the end of the target well. The current leakage profile can be generated by determining multiple current leakage rates as the drill having the BHA moves along the wellbore it is creating. The current leakage profile may then be matched to modeled or known leakage rate profiles to estimate the formation resistivity surrounding the wellbore.

Alternative to using current leakage rate profile, formation resistivity can be determined based on the current profile using equation (12), where formation resistivity can be calculated as:

$$Rf = \frac{Rpipe}{\left(\frac{\log(I(z1)/I(z2))}{z1 - z2}\right)^2} \tag{12}$$

where z1 is one measured depth, and z2 is another measured depth. Furthermore, Rpipe can be estimated based on pipe conductivity, pipe permeability, pipe dimension, mud conductivity, and operating frequency to improve the resistivity calculation in Eq. 12.

In addition, owing to such low operating frequency, the sensitivity of the current leakage rate to the formation resistivity drops whereas the formation resistivity increases. On the other hand, one can increase the operating frequency such that current leakage rate can be more sensitive to formation resistivity changes.

Consequently, if one can determine a current profile along a conductive material, such as BHA, a cased-hole well, etc., such current profile can be further utilized to determine the formation resistivity surrounding the conductive material.

For LWD/MWD applications, a conductive collar is used along the entire BHA in a drilling well. Therefore, one can apply 1) surface excitation at the wellhead or 2) excitation electrode(s) and return electrode(s) to generate currents traveling along the drilling well. Then, magnetic field measurements can be used to determine the current amplitude. Based on Ampere's law, the magnetic field H at low frequency surrounding the line source is expressed as $$\vec{H} = \frac{I}{2\pi r}\hat{\Phi} \tag{13}$$

A current source I may be generated along a conductive material which is a collar in LWD/MWD application. Then one sensor (such as magnetometer) can be installed on the collar with an isolation material between the collar and the sensor. Such isolation material will prevent current source from traveling to the sensor. With known separation (ΔS) between the sensor center and the collar center, one can calculate the current amplitude I based on Eq. 13, expressed as:

$$I=(2\pi\Delta S)\times(\vec{H}\cdot\hat{\Phi}) \tag{14}$$

where $\vec{H}$ is the sensor 1 measurement, which sensor 1 can be oriented at any angle as long as the orientation is not perpendicular to the tool azimuthal direction $\hat{\Phi}$. In addition, one can install multiple sensors to ensure accuracy of the current determination. Then, one can install multiple sets of the sensors at different locations along the conductive material to determine the current profile, and the presently disclosed methods can use such current profile to determine the formation resistivity surrounding the sensors.

Another method to determine the current is to utilize a toroid to directly determine the current amplitude I. The toroid is mounted on a conductive material (such as BHA collar) with isolation between the toroid and the conductive material. The toroid can directly determine the magnetic B field due to the current source ($B_{current}$) by measuring the current in the toroid ($I_{Toroid}$) and number of turns (N) for the toroid. Thus, the insert current is proportional to the received current of the toroid, $$B_{current} = \frac{\mu N I_{Toroid}}{2\pi L} \tag{15}$$

$$I_z = \oint_C \vec{H}\,d\vec{r} = \frac{B_{current}}{\mu}\times 2\pi L = N I_{Toroid} \tag{16}$$

where L is the radius of the toroid. Such toroid sensors can be installed at multiple locations along the conductive material (BHA) to determine the current profile along the conductive material. After acquiring the current profile, the presently disclosed methods can be used to determine the formation resistivity surrounding the conductive material.

Another alternative method to determine the current profile is to measure the voltage potential difference between the two points along the conductive material. In such cases, the sensors are physically connected to the conductive material. For the voltage potential measurements, a sensor can be installed either inside or outside the hollow structure. Since the property (Rpipe) of the conductive material can be determined in the lab, the current can be calculated as:

$$I(z) = \frac{V1 - V2}{Rpipe} \tag{17}$$

where z is the measured depth at a middle point between sensor 1 and sensor 2, and I(z) is the current at the point. Consequently, with multiple sensors located at different points along the conductive material, one can determine the voltage potential along the material and thereby calculate the current profile along the material using Eq. 17. Once the current profile is acquired, again the resistivity measurements can be provided using methods described above.

It is noted that the conductive material in LWD/MWD application refers to the collar along the BHA in a drilling well. In practice, the drilling well is open hole filled with mud. To improve the accuracy of the calculations mentioned above, such mud resistivity is considered as part of the BHA material. Conventional methods may be used to estimate the property (i.e. the resistivity) of the whole materials, including mud and BHA collar. On the other hand, for a wireline application, the conductive material refers to the logging tool bodies. Nonetheless, as long as a current source is generated along a conductive material where sensors are mounted outside the material and such sensor system is able to provide current profile along the material, the resistivity measurement can be provided using the proposed methods in the present disclosure.

Resistivity measurements may be determined using the current leakage rate according to the following method. First of all, a current source along the conductive material mentioned above must be generated, which can be achieved by a surface excitation source, a BHA excitation source with two or multiple electrodes, or other excitation methods. Then, the sensors are used to determine current profile along the material. Then modeling code will be used to calculate distinct current leakage rates with respect to different formation resistivities based on known properties (including pipe size and length, pipe conductivity and permeability, etc.) of the pipe used in the target well. In the end, the modeling responses may be compared with the measurement calculations to estimate formation resistivity properties surrounding the conductive material. Furthermore, one can also perform an inversion algorithm to accurately estimate the formation resistivity by matching the modeling responses with real measurements.

Statements of the Disclosure Include:

Statement 1: A method of drilling a subterranean wellbore, the method comprising: obtaining a current profile along a producer well; determining a producer well casing property profile and a formation resistivity parameter from the current profile using an inversion algorithm; obtaining survey data for the producer well and a first injector well drilled adjacent to the producer well; drilling a first section of a second injector well; obtaining survey data for the first section of the second injector well; generating a three-well forward simulation model using the survey data for the producer well, survey data for the first injector well, survey data for the first section of the second injector well, the producer well casing property profile, and the formation resistivity parameter; determining, using the three-well forward simulation model, a simulated magnetic field; measuring, at a magnetic sensor in the bottomhole assembly (BHA) of the second injector well, a first measured magnetic field; determining a calibration ratio based on the simulated magnetic field and the measured magnetic field; generating, using the three-well forward simulation model, a look-up table comprising magnetic field sensor positions and magnetic field information for a plurality of planned depth positions in a second section of the second injector well; and calibrating the look-up table using the calibration ratio.

Statement 2: A method according to Statement 1, further comprising: drilling a second section of the second injector well to a first planned depth position corresponding to one of the plurality of planned depth positions; measuring, at a magnetic sensor in the bottomhole assembly (BHA) of the second injector well, a second measured magnetic field; determining the true magnetic sensor position by looking up the second measured magnetic field in the look-up table; and determining the offset between the true magnetic sensor position and the first planned depth position.

Statement 3: A method according to Statement 2, further comprising: determining a ranging distance and direction to a second planned depth position using the offset between the true magnetic sensor position and the first planned depth position.

Statement 4: A method according to Statement 3, further comprising: adjusting one or more drilling parameters in order to obtain the ranging distance and direction.

Statement 5: A method according to Statement 4, further comprising updating the survey data of the second injector well with the true magnetic sensor position.

Statement 6: A method according to Statement 5, wherein adjusting one or more drilling parameters comprises adjusting the inclination and azimuth of the drill bit.

Statement 7: A method according to any one of the preceding Statements 1-6, wherein the current profile is obtained from magnetic ranging with surface excitation data collected during the drilling of the first injector well.

Statement 8: A method according to any one of the preceding Statements 1-7, wherein the casing property profile comprises at least one selected from the group consisting of producer well casing conductivity, producer well casing permeability, and producer well casing diameter.

Statement 9: A method according to any one of the preceding Statement 1-8, wherein the survey data comprises MWD data obtained during drilling of a wellbore.

Statement 10: A method according to any one of the preceding Statement 1-9, wherein the drilling a first section of a second injector well comprises drilling without ranging.

Statement 11: An apparatus comprising: a drill bit; a bottomhole assembly (BHA) coupled with the drill bit, the BHA comprising a magnetic field sensor; at least one processor in communication with the magnetic field sensor, wherein the processor is coupled with a non-transitory computer-readable storage medium having stored therein instructions which, when executed by the at least one processor, causes the at least one processor to: generate a three-well forward simulation model using survey data for a producer well, survey data for a first injector well, survey data for a first section of a second injector well, a producer well casing property profile, and a formation resistivity parameter; determine, using the three-well forward simulation model, a simulated magnetic field; measure, at a magnetic sensor in the bottomhole assembly (BHA), a first measured magnetic field; determine a calibration ratio based on the simulated magnetic field and the measured magnetic field; generate, using the three-well forward simulation model, a look-up table comprising magnetic field sensor positions and magnetic field information for a plurality of planned depth positions in a second section of the second injector well; and calibrate the look-up table using the calibration ratio.

Statement 12: An apparatus according to Statement 11, wherein the non-transitory computer-readable storage medium further contains a set of instructions that when executed by the at least one processor, further causes the at least one processor to: measure, at a magnetic sensor in the bottomhole assembly (BHA), a second measured magnetic field measured at a first planned depth position corresponding to one of a plurality of planned depth positions; determine the true magnetic sensor position by looking up the second measured magnetic field in the look-up table; and determine the offset between the true magnetic sensor position and the first planned depth position.

Statement 13: An apparatus according to Statement 12, wherein the non-transitory computer-readable storage medium further contains a set of instructions that when executed by the at least one processor, further causes the at least one processor to: determine a ranging distance and direction to a second planned depth position using the offset between the true magnetic sensor position and the first planned depth position.

Statement 14: An apparatus according to Statement 13, wherein the non-transitory computer-readable storage medium further contains a set of instructions that when executed by the at least one processor, further causes the at least one processor to: adjust one or more drilling parameters at the drill bit in order to obtain the ranging distance and direction.

Statement 15: An apparatus according to Statement 14, wherein the non-transitory computer-readable storage medium further contains a set of instructions that when executed by the at least one processor, further causes the at least one processor to: update the survey data of the second injector well with the true magnetic sensor position.

Statement 16: An apparatus according to Statement 14 or Statement 15, wherein adjust one or more drilling parameters comprises adjusting the inclination and azimuth of the drill bit.

Statement 17: A system comprising: a drill bit disposed within a wellbore; a bottomhole assembly (BHA) coupled with the drill bit, the BHA comprising a magnetic field sensor; at least one processor in communication with the magnetic field sensor, wherein the processor is coupled with a non-transitory computer-readable storage medium having stored therein instructions which, when executed by the at least one processor, causes the at least one processor to: generate a three-well forward simulation model using survey data for a producer well, survey data for a first injector well, survey data for a first section of a second injector well, a producer well casing property profile, and a formation resistivity parameter; determine, using the three-well forward simulation model, a simulated magnetic field; measure, at a magnetic sensor in the bottomhole assembly (BHA) of the second injector well, a first measured magnetic field;

determine a calibration ratio based on the simulated magnetic field and the measured magnetic field; generate, using the three-well forward simulation model, a look-up table comprising magnetic field sensor positions and magnetic field information for a plurality of planned depth positions in a second section of the second injector well; calibrate the look-up table using the calibration ratio; measure, at a magnetic sensor in the bottomhole assembly (BHA), a second measured magnetic field measured at a first planned depth position corresponding to one of a plurality of planned depth positions; determine the true magnetic sensor position by looking up the second measured magnetic field in the look-up table; and determine the offset between the true magnetic sensor position and the first planned depth position.

Statement 18: A system according to Statement 17, wherein the non-transitory computer-readable storage medium further contains a set of instructions that when executed by the at least one processor, further causes the at least one processor to: determine a ranging distance and direction to a second planned depth position using the offset between the true magnetic sensor position and the first planned depth position.

Statement 19: A system according to Statement 18, wherein the non-transitory computer-readable storage medium further contains a set of instructions that when executed by the at least one processor, further causes the at least one processor to: adjust one or more drilling parameters at the drill bit in order to obtain the ranging distance and direction.

Statement 20: A system according to Statement 19, wherein the non-transitory computer-readable storage medium further contains a set of instructions that when executed by the at least one processor, further causes the at least one processor to: update the survey data of the second injector well with the true magnetic sensor position.

Statement 21: A method of drilling a subterranean wellbore, the method comprising: obtaining magnetic ranging measurements between a first injector well and a producer well; determining a current profile or current leakage profile along the producer well using the magnetic ranging measurements; determining a producer well casing property profile and a formation resistivity parameter from the current profile or current leakage profile along the producer well; drilling a first section of a second injector well; and determining the position of the second injector well with respect to the first injector well and the producer well using the producer well casing property profile and the formation resistivity parameter.

Statement 22: A method of drilling a subterranean wellbore according to Statement 21, further comprising: determining, at a magnetic sensor in a bottomhole assembly (BHA) disposed in the second injector well, a magnetic sensor position; updating the survey data of the second injector well using the magnetic sensor position; and determining the position of the second injector well with respect to the first injector well and the producer well using the updated survey data.

Statement 23: A method of drilling a subterranean wellbore according to Statement 21 or Statement 22, wherein determining the current profile or current leakage profile comprises a BHA conductive body in the first injector well.

Statement 24: A method of drilling a subterranean wellbore according to Statement 23, wherein the BHA conductive body comprises a BHA collar.

Statement 25: A method of drilling a subterranean wellbore according to any one of the preceding Statements 21-24, wherein determining the current profile or current leakage profile includes magnetic ranging measurements comprising a magnetic field generated by leakage current on a casing of the first injector well.

Statement 26: A method of drilling a subterranean wellbore according to any one of the preceding Statements 21-25, further comprising: determining a current leakage profile along the producer well using the magnetic ranging measurements; and determining a producer well casing property profile and a formation resistivity parameter from the current leakage profile along the producer well.

Statement 27: A method of drilling a subterranean wellbore according to any one of the preceding Statements 21-26, wherein the magnetic ranging measurements are obtained from magnetic ranging with surface excitation data collected during drilling of the first injector well.

Statement 28: A method of drilling a subterranean wellbore according to any one of the preceding Statements 21-27, wherein the casing property profile comprises at least one selected from the group consisting of producer well casing conductivity, producer well casing permeability, and producer well casing diameter.

Statement 29: A method of drilling a subterranean wellbore according to any one of the preceding Statements 21-28, wherein the drilling the first section of the second injector well comprises drilling without ranging.

Statement 30: A method of drilling a subterranean wellbore according to any one of the preceding Statements 21-29, further comprising determining a current leakage rate from a current profile or current leakage profile comprising a BHA conductive body in the first injector well.

Statement 31: A method of drilling a subterranean wellbore according to Statement 30, further comprising determining a formation resistivity parameter using the current leakage rate.

Statement 32: A method of drilling a subterranean wellbore according to Statement 31, wherein the second injector BHA current leakage rate is assumed to be the same as the first injector BHA current leakage rate in determining the position of the second injector well with respect to the first injector well and the producer well using the producer well casing property profile and the formation resistivity parameter.

Statement 33: A method of drilling a subterranean wellbore according to any one of the preceding Statements 21-32, wherein either: the current profile is determined from the current leakage profile using integration along a depth axis; or the current leakage profile is determined from the current profile using differentiation along a depth axis.

Statement 34: A method of drilling a subterranean wellbore according to any one of the preceding Statements 21-33, wherein a current profile is determined along the producer well using the magnetic ranging measurements; and the producer well casing property profile and the formation resistivity parameter is determined from the current profile along the producer well.

Statement 35: A method of drilling a subterranean wellbore according to any one of the preceding Statements 21-33, wherein a current leakage profile is determined along the producer well using the magnetic ranging measurements; and the producer well casing property profile and the formation resistivity parameter is determined from the current leakage profile along the producer well.

We claim:

1. A method of drilling a subterranean wellbore, the method comprising:

obtaining magnetic ranging measurements between a first injector well and a producer well;

determining a current profile or a current leakage profile along the producer well using the magnetic ranging measurements;

determining a producer well casing property profile and a formation resistivity parameter from the current profile or current leakage profile along the producer well;

drilling a first section of a second injector well; and determining the position of the second injector well with respect to the first injector well and the producer well using the producer well casing property profile and the formation resistivity parameter.

2. The method of claim 1, further comprising:

determining, at a magnetic sensor in a bottomhole assembly (BHA) disposed in the second injector well, a magnetic sensor position;

updating the survey data of the second injector well using the magnetic sensor position; and determining the position of the second injector well with respect to the first injector well and the producer well using the updated survey data.

3. The method of claim 1, wherein either:

the current profile is determined from the current leakage profile using integration along a depth axis; or the current leakage profile is determined from the current profile using differentiation along a depth axis.

4. The method of claim 1, wherein a current profile is determined along the producer well using the magnetic ranging measurements; and the producer well casing property profile and the formation resistivity parameter is determined from the current profile along the producer well.

5. The method of claim 1, wherein a current leakage profile is determined along the producer well using the magnetic ranging measurements; and the producer well casing property profile and the formation resistivity parameter is determined from the current leakage profile along the producer well.

6. The method of claim 1, wherein the magnetic ranging measurements are obtained from magnetic ranging with surface excitation data collected during drilling of the first injector well.

7. The method of claim 1, wherein the casing property profile comprises at least one selected from the group consisting of producer well casing conductivity, producer well casing permeability, and producer well casing diameter.

8. The method of claim 1, wherein the drilling the first section of the second injector well comprises drilling without ranging.

9. An apparatus comprising:

a drill bit;

a bottomhole assembly (BHA) coupled to the drill bit, the BHA comprising a magnetic field sensor; and at least one processor in communication with the magnetic field sensor, wherein the at least one processor is coupled with a non-transitory computer-readable storage medium having stored therein instructions which, when executed by the at least one processor, causes the at least one processor to:

generate a three-well forward simulation model using survey data for a producer well, survey data for a first injector well, survey data for a first section of a second injector well, a producer well casing property profile, and a formation resistivity parameter;

determine, using the three-well forward simulation model, a simulated magnetic field;

measure, at a magnetic sensor in the BHA, a first measured magnetic field;

determine a calibration ratio based on the simulated magnetic field and the measured magnetic field;

generate, using the three-well forward simulation model, a look-up table comprising magnetic field sensor positions and magnetic field information for a plurality of planned depth positions in a second section of the second injector well; and calibrate the look-up table using the calibration ratio.

10. The apparatus of claim 9, wherein the non-transitory computer-readable storage medium further contains a set of instructions that when executed by the at least one processor, further causes the at least one processor to:

measure, at a magnetic sensor in the bottomhole assembly (BHA), a second measured magnetic field measured at a first planned depth position corresponding to one of a plurality of planned depth positions;

determine the true magnetic sensor position by looking up the second measured magnetic field in the look-up table; and determine the offset between the true magnetic sensor position and the first planned depth position.

11. The apparatus of claim 10, wherein the non-transitory computer-readable storage medium further contains a set of instructions that when executed by the at least one processor, further causes the at least one processor to:

determine a ranging distance and direction at the first planned depth position using the offset between the true magnetic sensor position and the first planned depth position.

12. The apparatus of claim 11, wherein the non-transitory computer-readable storage medium further contains a set of instructions that when executed by the at least one processor, further causes the at least one processor to:

adjust one or more drilling parameters at the drill bit in order to obtain the planned ranging distance and direction.

13. The apparatus of claim 12, wherein the non-transitory computer-readable storage medium further contains a set of instructions that when executed by the at least one processor, further causes the at least one processor to:

update the survey data of the second injector well with the true magnetic sensor position.

14. The apparatus of claim 13, wherein adjusting one or more drilling parameters comprises adjusting the inclination and azimuth of the drill bit.

15. A system comprising:

a drill bit;

a bottomhole assembly (BHA) coupled with the drill bit, the BHA comprising a magnetic field sensor; and at least one processor in communication with the magnetic field sensor, wherein the at least one processor is coupled with a non-transitory computer-readable storage medium having stored therein instructions which, when executed by the at least one processor, causes the at least one processor to:

generate a three-well forward simulation model using survey data for a producer well, survey data for a first injector well, survey data for a first section of a second injector well, a producer well casing property profile, and a formation resistivity parameter;

determine, using the three-well forward simulation model, a simulated magnetic field;

measure, at a magnetic sensor in the bottomhole assembly (BHA) of the second injector well, a first measured magnetic field;

determine a calibration ratio based on the simulated magnetic field and the measured magnetic field;

generate, using the three-well forward simulation model, a look-up table comprising magnetic field sensor positions and magnetic field information for a plurality of planned depth positions in a second section of the second injector well;

calibrate the look-up table using the calibration ratio;

measure, at a magnetic sensor in the bottomhole assembly (BHA), a second measured magnetic field measured at a first planned depth position corresponding to one of a plurality of planned depth positions;

determine the true magnetic sensor position by looking up the second measured magnetic field in the look-up table; and determine the offset between the true magnetic sensor position and the first planned depth position.

16. The system of claim 15, wherein the non-transitory computer-readable storage medium further contains a set of instructions that when executed by the at least one processor, further causes the at least one processor to:

determine a ranging distance and direction at the first planned depth position using the offset between the true magnetic sensor position and the first planned depth position.

17. The system of claim 16, wherein the non-transitory computer-readable storage medium further contains a set of instructions that when executed by the at least one processor, further causes the at least one processor to:

adjust one or more drilling parameters at the drill bit in order to obtain the planned ranging distance and direction.

18. The system of claim 17, wherein the non-transitory computer-readable storage medium further contains a set of instructions that when executed by the at least one processor, further causes the at least one processor to:

update the survey data of the second injector well with the true magnetic sensor position.

* * * * *